US007233190B2

(12) United States Patent
Tanzawa

(10) Patent No.: US 7,233,190 B2
(45) Date of Patent: Jun. 19, 2007

(54) VOLTAGE SUBTRACTING CIRCUIT CARRYING OUT VOLTAGE SUBTRACTION BY CONVERTING INPUT VOLTAGE INTO CURRENT, INTENSITY DETECTING CIRCUIT, AND SEMICONDUCTOR INTEGRATED CIRCUIT DEVICE USING THE SAME

(75) Inventor: Toru Tanzawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 7 days.

(21) Appl. No.: 11/017,923

(22) Filed: Dec. 22, 2004

(65) Prior Publication Data

US 2005/0162210 A1 Jul. 28, 2005

(30) Foreign Application Priority Data

Dec. 25, 2003 (JP) ..... 2003-431450

(51) Int. Cl.
*G06G 7/12* (2006.01)

(52) U.S. Cl. ..... 327/355; 341/156

(58) Field of Classification Search ..... 327/355; 341/156

See application file for complete search history.

(56) References Cited

U.S. PATENT DOCUMENTS 4,214,232 A * 7/1980 Shaw et al. ..... 341/156

5,389,929 A * 2/1995 Nayebi et al. ..... 341/156

OTHER PUBLICATIONS

Hiroki Ishikuro, et al., "A Single-Chip CMOS Bluetooth Transceiver with 1.5MHz IF and Direct Modulation Transmitter", ISSCC Digest of Technical Papers, ISSCC 2003, Session 5, Wireless-Pan Transceivers, Paper 5.5, Feb. 2003, pp. 94-95.

Katsuji Kimura, "A CMOS Logarithmic IF Amplifier with Unbalanced Source-Coupled Pairs", IEEE Journal of Solid-State Circuits, vol. 28, No. 1, Jan. 1993, pp. 78-83.

* cited by examiner

*Primary Examiner*—Kenneth B. Wells
(74) *Attorney, Agent, or Firm*—Oblon, Spivak, McClelland, Maier & Neustadt, P.C.

(57) ABSTRACT

A voltage subtracting circuit includes a conversion circuit, a holding circuit, and a differential voltage generator. The conversion circuit converts a first voltage input during a first period into a first current proportional to the first voltage. The conversion circuit further converts a second voltage input during a second period following the first period into a second current proportional to the second voltage. The holding circuit holds the first current during the first period as a third voltage. The holding circuit further outputs the first current during the second period on the basis of the third voltage. The differential voltage generator outputs a differential voltage between the second voltage and the first voltage during the second period on the basis of the second current output by the conversion circuit and the first current output by the holding circuit.

16 Claims, 26 Drawing Sheets

D(PLL)<D(PA),D(MIX)

D(PLL)<D(PA),D(MIX)

D(PLL)<D(PA),D(MIX)

VOLTAGE SUBTRACTING CIRCUIT CARRYING OUT VOLTAGE SUBTRACTION BY CONVERTING INPUT VOLTAGE INTO CURRENT, INTENSITY DETECTING CIRCUIT, AND SEMICONDUCTOR INTEGRATED CIRCUIT DEVICE USING THE SAME

CROSS-REFERENCE TO RELATED APPLICATIONS

This application is based upon and claims the benefit of priority from prior Japanese Patent Application No. 2003-431450, filed Dec. 25, 2003, the entire contents of which are incorporated herein by reference.

BACKGROUND OF THE INVENTION

1. Field of the Invention

The present invention relates to a voltage subtracting circuit, an intensity detecting circuit, and a semiconductor integrated circuit device. The present invention relates to a technique such as Bluetooth which is used for radio communications.

2. Description of the Related Art

In recent years, much attention has been paid to Bluetooth, which is a short distance wireless communication system that connects mobile apparatuses such as notebook personal computers, PDAs (Personal Digital Assistants), and cellular phones together.

With a radio communication system such as Bluetooth, the intensity of electric waves varies significantly depending on the distance between a transmitting apparatus and a receiving apparatus. Accordingly, the receiver must have a mechanism that adjusts an amplification factor depending on the intensity of a received signal to stabilize the signal intensity. Such a system has been proposed in, for example, Hiroki Ishikuro et al., "A Single-Chip CMOS Bluetooth Transceiver with 1.5 MHz IF and Direct Modulation Transmitter", ISSCC Digest of Technical Papers, February 2003, p. 94 to 95 and Katsuji Kimura, "A CMOS Logarithmic IF Amplifier with Unbalanced Source-Coupled Pairs", IEEE Journal of Solid-State Circuits, Vol. 28, No. 1, January 1993, p. 78 to 83. However, the detection characteristic of the conventional mechanism is dependent on parameters for circuits and devices. Thus, with the conventional mechanism, stable detections are difficult.

BRIEF SUMMARY OF THE INVENTION

A voltage subtracting circuit according to an aspect of the present invention includes:

a conversion circuit which converts a first voltage input during a first period into a first current proportional to the first voltage and which converts a second voltage input during a second period following the first period into a second current proportional to the second voltage;

a holding circuit which holds the first current during the first period as a third voltage and which outputs the first current during the second period on the basis of the third voltage; and a differential voltage generator which outputs a differential voltage between the second voltage and the first voltage during the second period on the basis of the second current output by the conversion circuit and the first current output by the holding circuit.

An intensity detecting circuit according to an aspect of the present invention includes:

a voltage subtracting circuit which executes a subtraction on a first voltage and a second voltage;

a reference voltage generator which generates a temporally fixed reference voltage and which supplies the reference voltage to the voltage subtracting circuit during a first period as the first voltage; and a voltage converting circuit which generates the second voltage from a temporally varying signal voltage and which supplies the second voltage to the voltage subtracting circuit during a second period following the first period, the voltage subtracting circuit including:

a conversion circuit which converts the first voltage input during the first period into a first current proportional to the first voltage and which converts the second voltage input during the second period following the first period into a second current proportional to the second voltage;

a holding circuit which holds the first current during the first period as a third voltage and which outputs the first current during the second period on the basis of the third voltage; and a differential voltage generator which outputs a differential voltage between the second voltage and the first voltage during the second period on the basis of the second current output by the conversion circuit and the first current output by the holding circuit.

A semiconductor integrated circuit device according to an aspect of the present invention includes:

a first amplification circuit which amplifies a radio carrier signal received when data is received;

an intensity detecting circuit which controls a gain of the first amplification circuit;

a voltage control oscillating circuit which generates an oscillation signal;

a mixer which mixes the oscillation signal and the radio carrier signal amplified by the first amplification circuit together to down-convert a frequency of the radio carrier signal to an intermediate frequency;

a second amplification circuit which is operative when data is transmitted, to amplify the oscillation signal to be transmitted; and a PLL circuit which controls an oscillation frequency of the oscillation signal, the intensity detecting circuit including:

a voltage subtracting circuit which executes a subtraction on a first voltage and a second voltage and which controls an amplification factor of the first amplification circuit in accordance with a result of the subtraction;

a reference voltage generator which generates a temporally fixed reference voltage and which supplies the reference voltage to the voltage subtracting circuit during a first period as the first voltage; and a voltage converting circuit which generates the second voltage from an output signal from the mixer and an inverted signal of the output signal and which supplies the second voltage to the voltage subtracting circuit during a second period following the first period, the voltage subtracting circuit including:

a conversion circuit which converts the first voltage input during the first period into a first current proportional to the first voltage and which converts the second voltage input during the second period following the first period into a second current proportional to the second voltage;

a holding circuit which holds the first current during the first period as a third voltage and which outputs the first current during the second period on the basis of the third voltage; and a differential voltage generator connected to the conversion circuit and the holding circuit during the second period to output a differential voltage between the second voltage and the first voltage on the basis of the second current output by the conversion circuit and the first current output by the holding circuit.

DETAILED DESCRIPTION OF THE INVENTION

Figure 1:
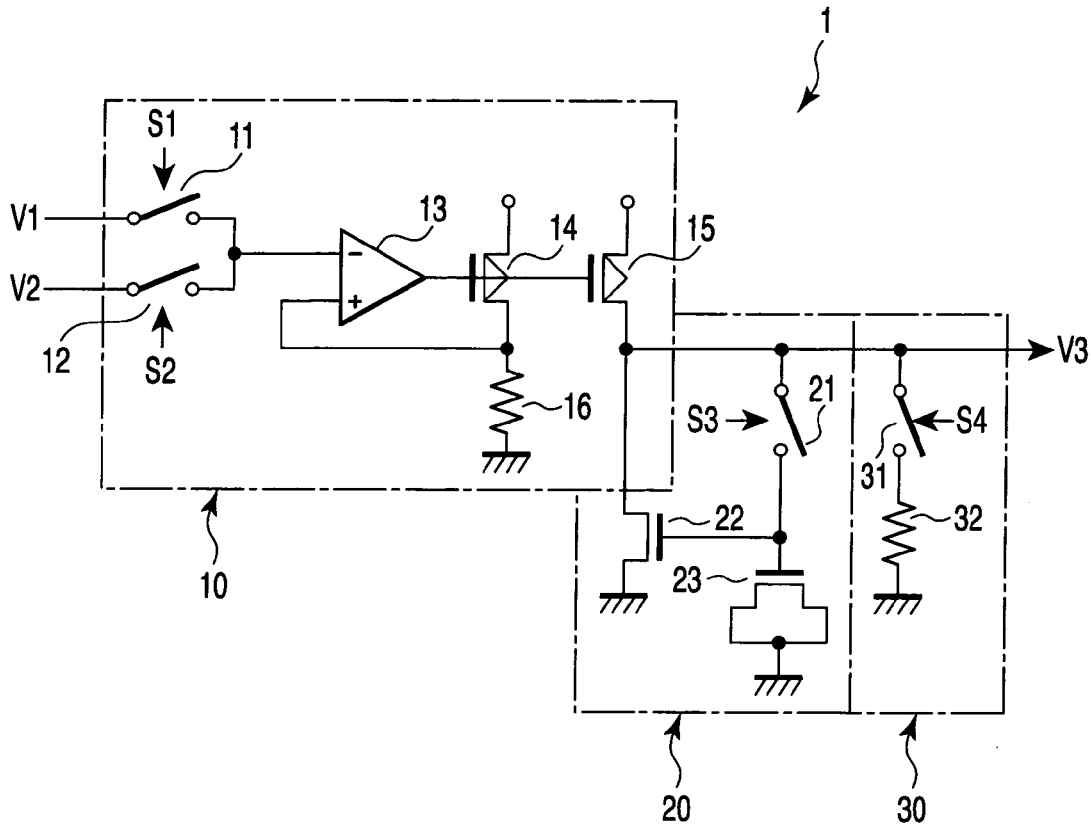
FIG. 1 is a circuit diagram of a voltage subtracting circuit according to a first embodiment of the present invention.

With reference to FIG. 1, description will be given of a voltage subtracting circuit according to a first embodiment of the present invention.

FIG. 1 is a circuit diagram of a voltage subtracting circuit according to a first embodiment of the present invention. As shown in the figure, the voltage subtracting circuit 1 comprises a voltage/current converting circuit 10, a voltage holding and current output circuit 20, and a voltage output section 30.

The voltage/current converting circuit 10 converts input voltages V1 and V2 into currents. The voltage/current converting circuit 10 comprises switch elements 11 and 12, an operational amplifier 13, a p-channel MOS transistors 14 and 15, and a resistance element 16. Control signals S1 and S2 control opening and closing of the switch elements 11 and 12. A voltage V1 is input to one end of the switch element 11. A voltage V2 is input to one end of the switch element 12. The other ends of the switch elements 11 and 12 are connected together and to an inverted input terminal of the operational amplifier 13. p-channel MOS transistors 14 and 15 form a current mirror circuit. Sources of the p-channel MOS transistors 14 and 15 are connected to a power supply potential. Gates of the p-channel MOS transistors 14 and 15 are connected together. A drain of the p-channel MOS transistor 14 is connected to a normal input terminal of the operational amplifier 13 and to one end of the resistance element 16. The other end of the resistance element 16 is connected to a ground potential.

The voltage holding and current output circuit 20 comprises a switch element 21 and n-channel MOS transistors 22 and 23. A control signal S3 controls opening and closing of the switch element 21. One end of the switch element 21 is connected to a drain of the p-channel MOS transistor 15 of the voltage/current converting circuit 10. Further, the other end of the switch element 21 is connected to gates of the n-channel MOS transistors 22 and 23. A drain of the n-channel MOS transistor 22 is connected to a drain (one end of the switch element 21) of the p-channel MOS transistor 15. A source of the n-channel MOS transistor 22 is connected to the ground potential. A source and a drain of the n-channel MOS transistor 23 are connected together and to the ground potential. That is, the n-channel MOS transistor 23 functions as a capacitor element. In the voltage holding and current output circuit 20, the n-channel MOS transistor 23 holds a voltage while the switch element 21 is on (closed). The p-channel MOS transistor 22 supplies a current while the switch element 21 is off (open).

A voltage output section 30 comprises a switch element 31 and a resistance element 32. A control signal S4 controls opening and closing of the switch element 31. One end of the switch element 31 is connected to the drain of the p-channel MOS transistor 15 of the voltage/current converting circuit 10. Further, the other end of the switch element 31 is connected to one end of the resistance element 32. The other end of the resistance element 32 is connected to the ground potential. The voltage output section 30 outputs a voltage drop in the resistance element 32 as an output voltage V3 while the switch element 31 is on (closed).

Figure 2:
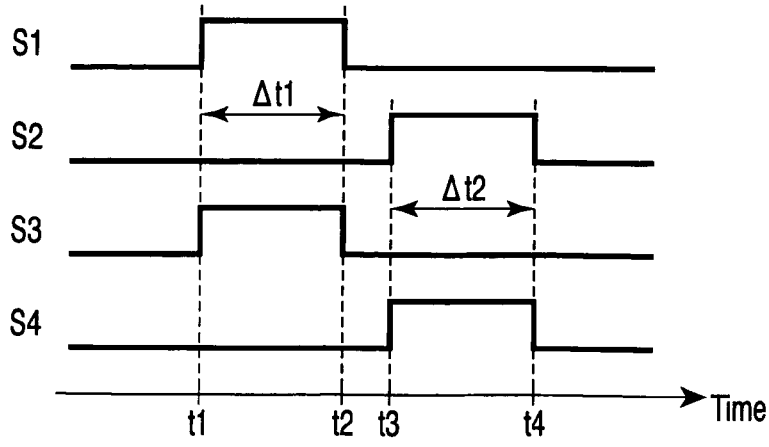
FIG. 2 is a timing chart of control signals that control the voltage subtracting circuit according to the first embodiment of the present invention.

FIG. 2 is a timing chart of control signals S1 to S4 that control the switch elements 11, 12, 21, and 31. As shown in the figure, the control signals S1 and S3 shift to an "H" level at a time t1 and to an "L" level at a time t2. That is, during the period Δt1 between times t1 and t2, the switch elements 11 and 21 are on. The control signals S2 and S4 shift to the "H" level at a time t3 and to the "L" level at a time t4. That is, during the period Δt2 between times t3 and t4, the switch elements 12 and 31 are on.

Figure 3:
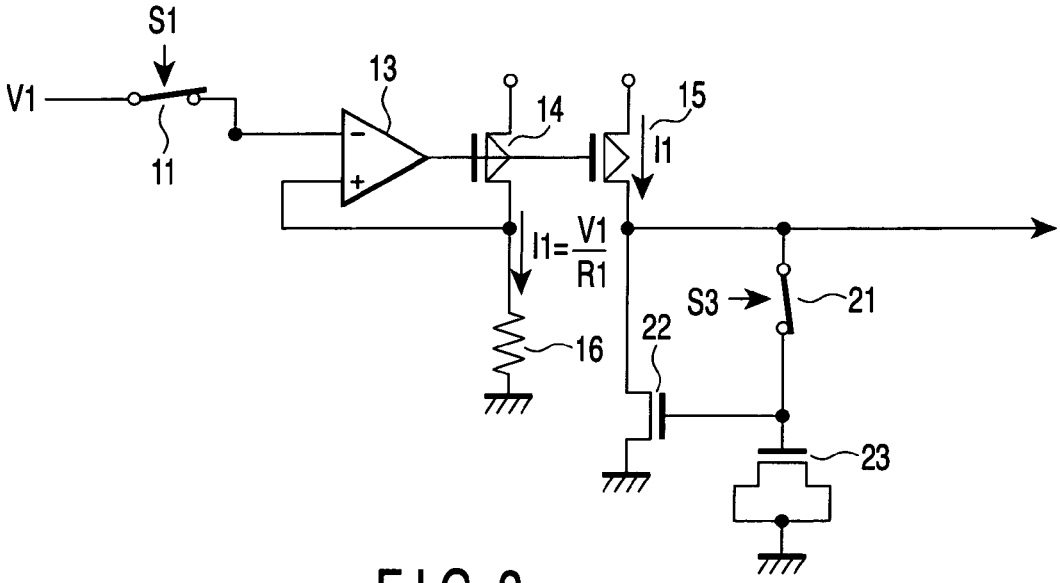
FIG. 3 is a circuit diagram of the voltage subtracting circuit according to the first embodiment of the present invention, showing a period when control signals S1 and S3 are at an "H" level.

Now, operations of the voltage subtracting circuit will be described below. First, at the time t1, the control signals S1 and S3 shift to the "H" level. FIG. 3 shows the state during the period Δt1. As shown in the figure, the control signals S1 and S3 shift to the "H" level to turn on the switch elements 11 and 21. Consequently, the voltage V1 is input to the inverted input terminal of the operational amplifier 13 via the switch element 11. A current I1 proportional to the input voltage V1 flows through the p-channel MOS transistor 14. The value of the current is I1=(V1/R1). In this case, R1 denotes a resistance value for the resistance element 16. The current I1 also flows through the p-channel MOS transistor 15, which forms a current mirror circuit together with the p-channel MOS transistor 14. The current I1 also flows through the n-channel MOS transistor 22. Consequently, a capacitor element (n-channel MOS transistor 23) holds a gate voltage required for the current I1 to flow through the n-channel MOS transistor 22.

Figure 4:
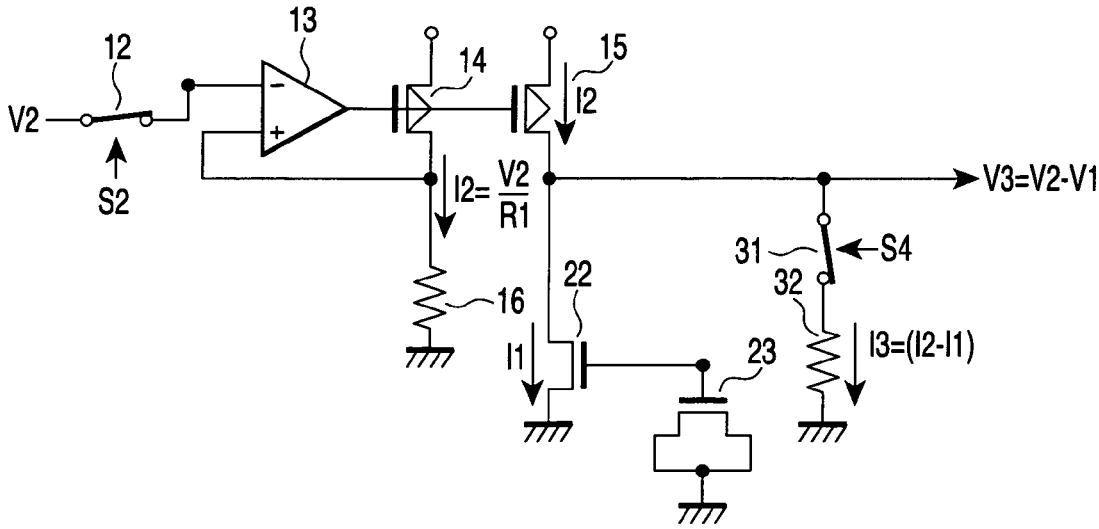
FIG. 4 is a circuit diagram of the voltage subtracting circuit according to the first embodiment of the present invention, showing a period when control signals S2 and S4 are at the "H" level.

Then, at the time t2, the control signals S1 and S3 shift to the "L" level. Subsequently, at the time t3, the control signals S2 and S4 shift to the "H" level. FIG. 4 shows the state during the period Δt2. As shown in the figure, the control signals S2 and S4 shift to the "H" level to turn on the switch elements 12 and 31. Consequently, the voltage V2 is input to the inverted input terminal of the operational amplifier 13. A current I2 proportional to the input voltage V1 flows through the p-channel MOS transistor 14. The value of the current is I2=(V2/R1). The current I2 also flows through the p-channel MOS transistor 15, which forms the current mirror circuit together with the p-channel MOS transistor 14. On the other hand, when the switch element 21 is turned off, a current corresponding to the voltage charged in the capacitor element 23 flows through the n-channel MOS transistor 22. This voltage is charged in the capacitor element 23 during the period Δt1. Consequently, the current I1 flows through the n-channel MOS transistor 22. Then, a current I3=(I2−I1) flows through the resistance element 32. Accordingly, provided that the resistance value of the resistance element 32 is defined as R1, an output voltage V3 is V3=R1·I3=R1·(I2−I1)=R1·((V2/R1)−(V1/R1))=V2−V1. That is, the differential voltage between the input voltages V1 and V2 can be extracted.

The voltage subtracting circuit according to the present embodiment provides accurate results of voltage subtractions.

The voltage subtracting circuit according to the present embodiment uses the same voltage/current converting circuit to convert two voltages input in a time series manner into currents. Then, the voltage subtracting circuit carries out a subtraction on the currents. The voltage subtracting circuit then converts the result of the current subtraction into voltage again. This serves to reduce the adverse effect of a variation in process or temperature on the result of the voltage subtraction. The voltage subtracting circuit can always carry out accurate voltage subtractions. More specifically, since the input voltages V1 and V2 are externally input, they have similar variations and temperature characteristics. Then, provided that the resistance elements 16 and 32 have the same resistance value, the output voltage V3=R1·((V2/R1)−(V1/R1)). That is, the equation has no resistance value term. Accordingly, even if for example, the resistance elements 16 and 32 have a process variation, the result of a voltage subtraction is not affected by the variation. Moreover, the same voltage/current converting circuit converts the two input voltages V1 and V2, input in a time series manner, into currents. Consequently, even if the elements forming the voltage/current converting circuit have a process variation or have their characteristics varied by the temperature, the variation is offset during the current subtraction. Therefore, the result of the voltage subtraction is not affected by the process variation.

Now, description will be given of a voltage subtracting circuit according to a second embodiment of the present invention. The present embodiment corresponds to the first embodiment which extracts the amplitude of the input voltage V2 by using the input voltage V1 as a reference voltage.

Figure 5:
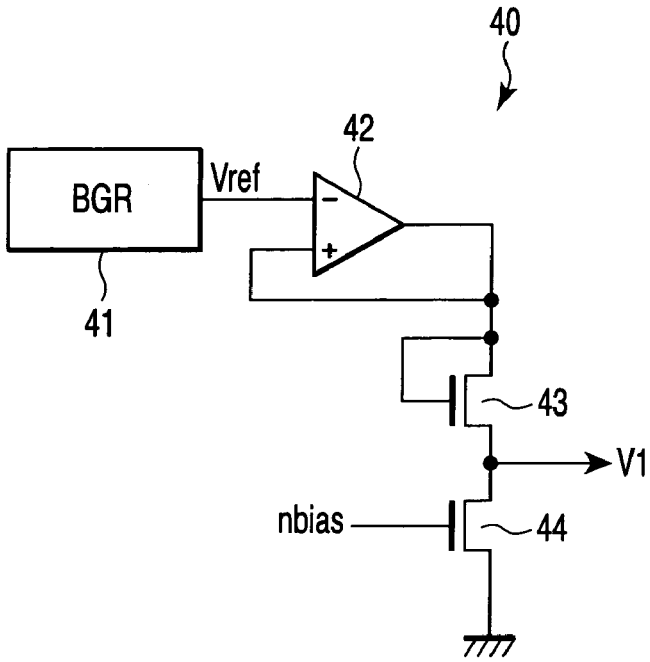
FIG. 5 is a circuit diagram of a reference voltage generator that generates an input voltage to a voltage subtracting circuit according to a second embodiment of the present invention.

FIG. 5 is a circuit diagram of a reference voltage generator that generates an input voltage V1 in FIG. 1. As shown in the figure, a reference voltage generating circuit 40 comprises a band gap reference circuit 41, an operational amplifier 42, and n-channel MOS transistors 43 and 44.

The band gap reference circuit 41 outputs a specified voltage Vref that is not substantially dependent on the temperature. The specified voltage Vref is connected to an inverted input terminal of the operational amplifier 42. An output terminal of the operational amplifier 42 is connected to a normal input terminal of the operational amplifier 42. A drain and a gate of the n-channel MOS transistor 43 are connected together and to the output terminal of the operational amplifier 42. A voltage nbias is applied to a gate of the n-channel MOS transistor 44. A source of the n-channel MOS transistor 44 is grounded. A drain of the n-channel MOS transistor 44 is connected to a source of the n-channel MOS transistor 43. The voltage V1 is output from the connection node between the n-channel MOS transistors 43 and 44.

Figure 6:
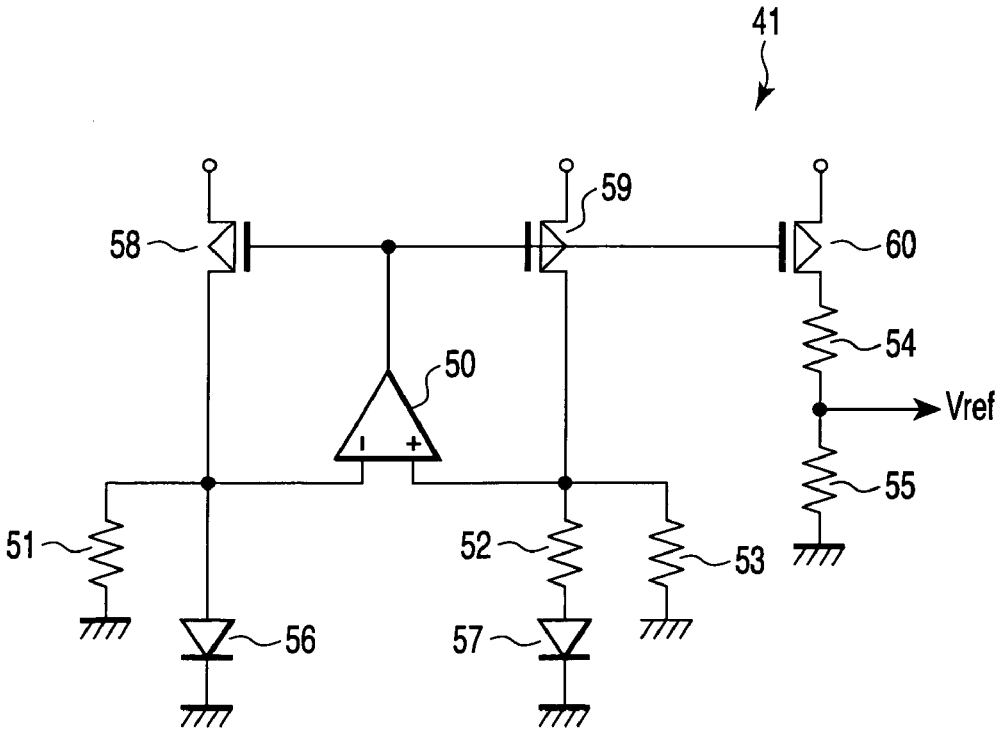
FIG. 6 is a circuit diagram of a band gap reference circuit.

FIG. 6 shows an example of a specific configuration of the band gap reference circuit 41 in FIG. 5. As shown in the figure, the band gap reference circuit 41 comprises an operational amplifier 50, resistance elements 51 to 55, diodes 56 ad 57, and p-channel MOS transistors 58 to 60. An inverted input terminal of the operational amplifier 50 connects to one end of the resistance element 51 and an anode of the diode 56. The other end of the resistance element 51 and a cathode of the diode 56 are grounded. One end of each of the resistance elements 52 and 53 is connected to a normal input terminal of the operational amplifier 50. The other end of the resistance element 53 is grounded. Further, the other end of the resistance element 52 is connected to an anode of the diode 57. A cathode of the diode 57 is grounded. Sources of the p-channel MOS transistors 58 to 60 are connected to a power supply potential. Gates of the p-channel MOS transistors 58 to 60 are connected together and to an output terminal of the operational amplifier 50. A drain of the p-channel MOS transistor 58 is connected to the inverted input terminal of the operational amplifier 50. A drain of the p-channel MOS transistor 59 is connected to the normal input terminal of the operational amplifier 50. The resistance elements 54 and 55 are connected in series between a drain of the p-channel MOS transistor 60 and the ground potential. The voltage Vref is output from the connection node between the resistance elements 54 and 55.

Figure 7:
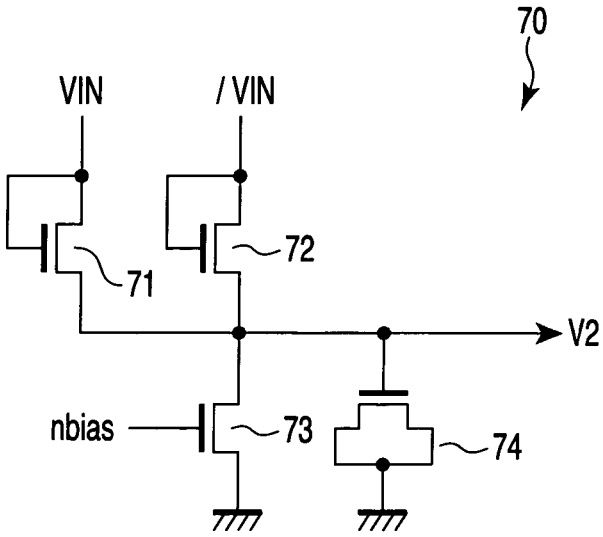
FIG. 7 is a circuit diagram of a voltage converting circuit that generates an input voltage to the voltage subtracting circuit according to the second embodiment of the present invention.

FIG. 7 is a circuit diagram of a voltage converting circuit that generates the input voltage V2 in FIG. 1. As shown in the figure, a voltage converting circuit 70 comprises n-channel MOS transistors 71 to 74. A drain and a gate of each of the n-channel MOS transistors 71 and 72 are connected together. Signal voltages VIN and/VIN are input to the n-channel MOS transistors 71 and 72, respectively. Sources of the n-channel MOS transistors 71 and 72 are connected together. A voltage nbias is applied to a gate of the n-channel MOS transistor 73. A source of the n-channel MOS transistor 73 is grounded. A drain of the n-channel MOS transistor 73 is connected to the sources of the n-channel MOS transistors 71 and 72. A gate of the MOS transistor 74 is connected to the sources of the MOS transistors 71 and 72. A source and a drain of the n-channel MOS transistor 74 are grounded. The voltage V2 is output from the common connection node between the sources of the n-channel MOS transistors 71 and 72 and the drain of the n-channel MOS transistor 73 and the gate of the n-channel MOS transistor 74.

Now, operations of the reference voltage generator 40 and voltage converting circuit 70 will be described together with the voltage subtracting circuit 1. In the reference voltage generating circuit 40, the band gap reference circuit 41 outputs the specified voltage Vref. Then, the reference voltage generating circuit 40 outputs V1=Vref−Vth provided that the n-channel MOS transistor 43 has a threshold Vth.

The signal voltage VIN having an operating point (DC component) Vref as well as the inverted signal /VIN of VIN are input to the voltage converting circuit 70. Then, the voltage converting circuit 70 outputs V2=Vamp+Vref−Vth provided that the threshold voltage of the n-channel MOS transistors 71 and 72 is the same as the voltage Vth of the n-channel MOS transistor 43. In this case, Vamp denotes the amplitude of the signal voltage VIN.

Then, the voltage subtracting circuit 1 outputs V3=V2−V1=Vamp. That is, the amplitude of the signal voltage VIN is extracted.

A more specific description will be given. It is assumed that in the reference voltage generator 40, Vref=1.2 V and Vth=0.5 V. Then, the reference voltage generator 40 outputs V1=1.2−0.5=0.7 V.

Figure 8:
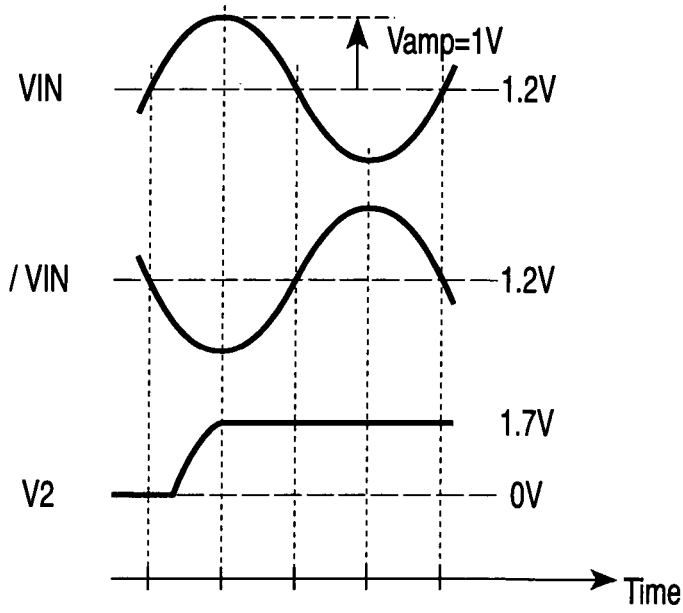
FIG. 8 is a waveform diagram of an input voltage to and an output voltage from the reference voltage generator according to the second embodiment of the present invention.

Further, it is assumed that such signal voltages VIN and/VIN as those shown in FIG. 8 are input to the voltage converting circuit 70. That is, the signal voltages have an operating point of 1.2 V and an amplitude of 1 V. The threshold Vth of the MOS transistors 71 and 72 is assumed to be 0.5 V. Then, the voltage V2=1 V+1.2 V−0.5 V=1.7 V.

The voltages V1 and V2 are input to the voltage subtracting circuit 1. As a result, the voltage subtracting circuit 1 outputs V3=V2−V1=1.7 V−0.7 V=1.0 V.

The voltage subtracting circuit according to the present embodiment can produce effects similar to those of the first embodiment. Further, the amplitude of the signal voltage can be extracted by inputting the reference voltage as the voltage V1 and inputting a signal voltage having an operating point of the reference voltage, as the voltage V2.

Figure 9:
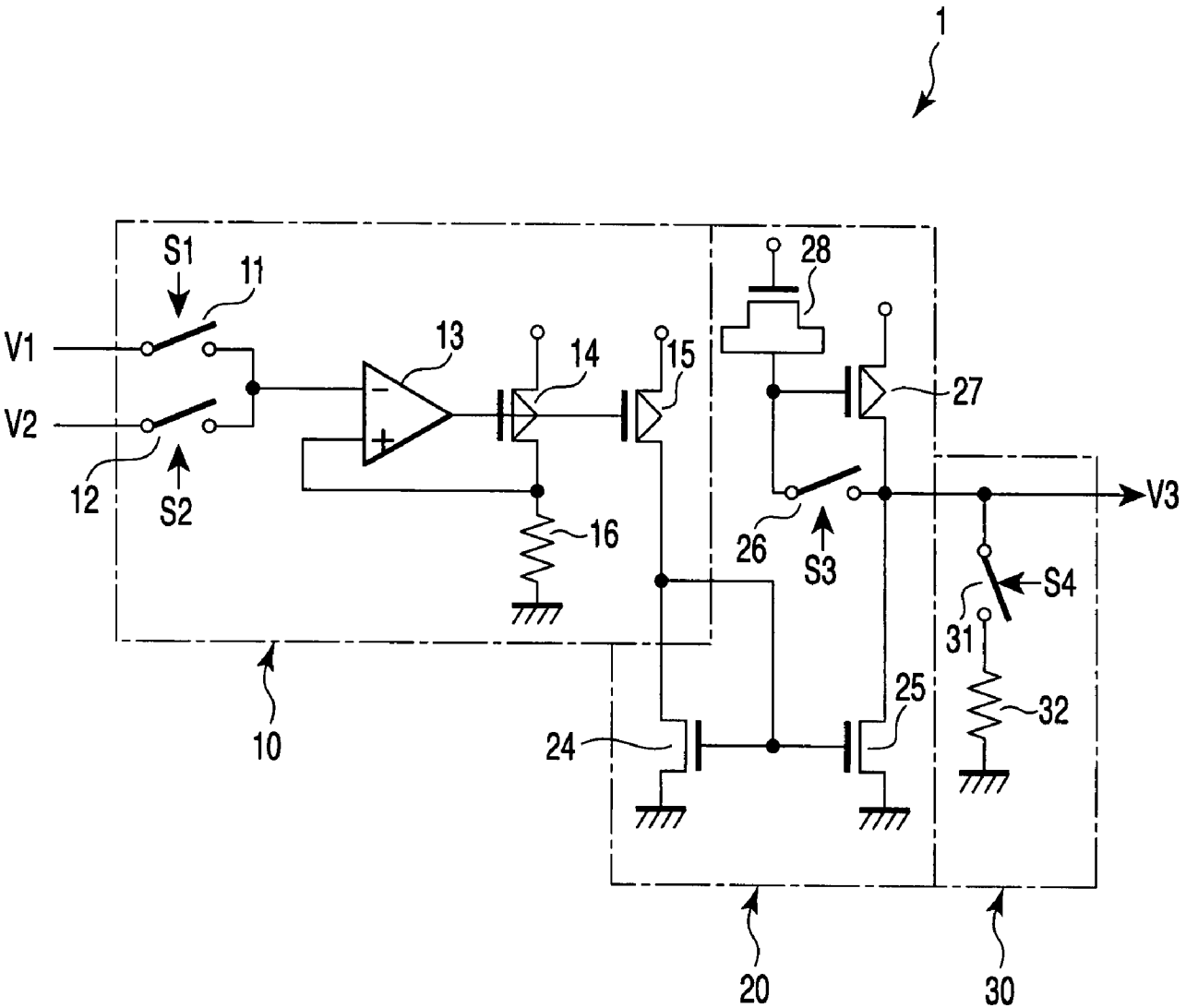
FIG. 9 is a circuit diagram of a voltage subtracting circuit according to a third embodiment of the present invention.

Now, description will be given of a voltage subtracting circuit according to a third embodiment of the present invention. The present embodiment obtains V3=V1−V2 instead of V3=V2−V1 in the first embodiment. FIG. 9 is a circuit diagram of the voltage subtracting circuit according to the present embodiment. As shown in the figure, the voltage subtracting circuit 1 comprises the voltage/current converting circuit 10, the voltage holding and current output circuit 20, and the voltage output section 30.

The configurations of the voltage/current converting circuit 10 and voltage output section are similar to those of the first embodiment, so that their description is omitted. The switch elements 11, 12, and 31 operate in response to the control signals S1, S2, and S4.

The voltage holding and current output circuit 20 comprises n-channel transistors 24, 25, and 28, a switch element 26, and a p-channel MOS transistor 27. The control signal S3 controls opening and closing of the switch element 26. Gates of the n-channel MOS transistors 24 and 25 are connected together to form a current mirror circuit. A drain and a gate of the n-channel MOS transistor 24 and a gate of the p-channel MOS transistor 25 are connected to the drain of the p-channel MOS transistor 15 of the voltage/current converting circuit 10. Sources of the n-channel MOS transistors 24 and 25 are grounded. A drain of the n-channel MOS transistor 25 is connected to one end of the switch element 26 and a drain of the p-channel MOS transistor 27. A source of the p-channel MOS transistor 27 is connected to the power supply potential. A gate of the p-channel MOS transistor 27 is connected to the other end of the switch element 26. A gate of the n-channel MOS transistor 28 is connected to the power supply potential. A source and a drain of the n-channel MOS transistor 28 are connected together and to a gate of the p-channel MOS transistor 27 and the other end of the switch element 26. The connection node between the p-channel MOS transistor 27 and the switch element 26 and the n-channel MOS transistor 25 is connected to a voltage V3 output node.

Figure 10:
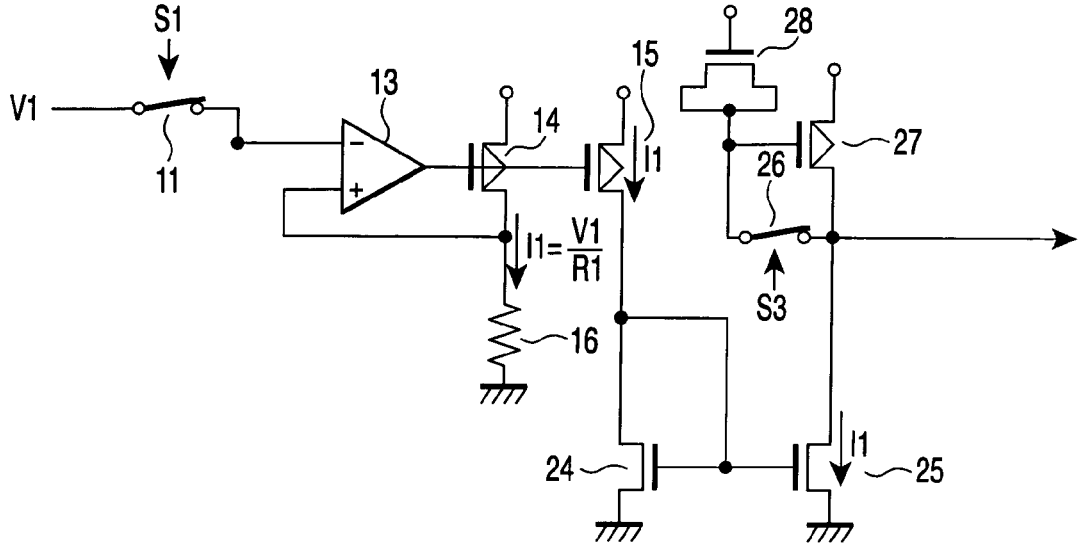
FIG. 10 is a circuit diagram of the voltage subtracting circuit according to the third embodiment of the present invention, showing a period when the control signals S1 and S3 are at the "H" level.

Now, operations of the voltage subtracting circuit will be described. Timings for the control circuits controlling the switch elements 11, 12, 26, and 31 are similar to those in FIG. 2. First, at the time t1, the control signals S1 and S3 shift to the "H" level. FIG. 10 shows the state during the period Δt1. As shown in the figure, the control signals S1 and S3 shift to the "H" level to turn on the switch elements 11 and 26. Consequently, the voltage V1 is input to the inverted input terminal of the operational amplifier 13 via the switch element 11. The current I1 proportional to the input voltage V1 flows through the p-channel MOS transistor 14. The current I1 also flows through the p-channel MOS transistor 15, which forms a current mirror circuit together with the p-channel MOS transistor 14. The current I1 also flows through the n-channel MOS transistor 24. Consequently, the current I1 also flows through the n-channel MOS transistor 25, which forms a current mirror circuit together with the n-channel MOS transistor 24. The current I1 also flows through the p-channel MOS transistor 27. Then, a capacitor element (n-channel MOS transistor 28) holds a gate voltage required for the current I1 to flow through the p-channel MOS transistor 27

Figure 11:
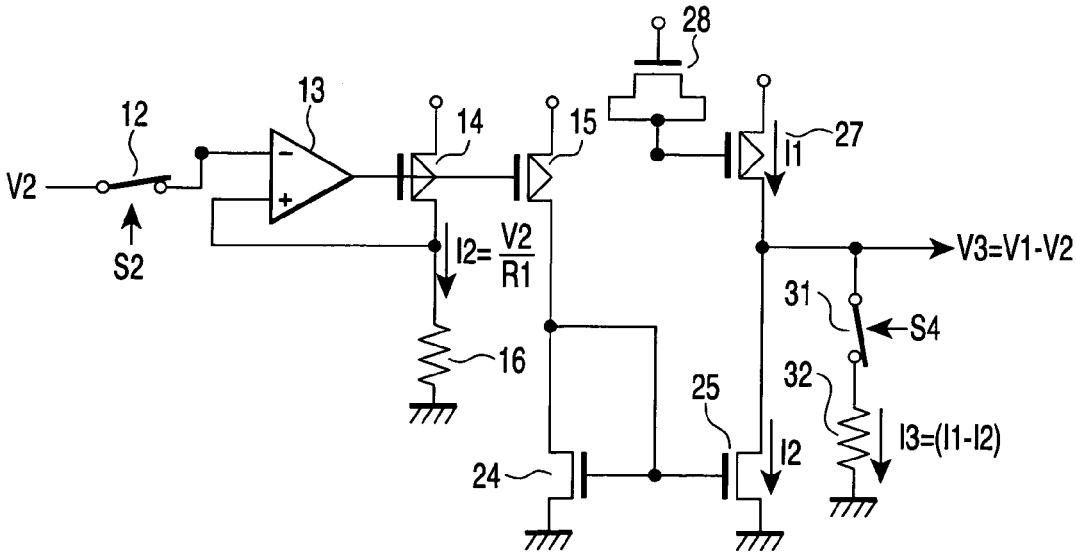
FIG. 11 is a circuit diagram of the voltage subtracting circuit according to the third embodiment of the present invention, showing a period when the control signals S2 and S4 are at the "H" level.

Then, at the time t2, the control signals S1 and S3 shift to the "L" level. Subsequently, at the time t3, the control signals S2 and S4 shift to the "H" level. FIG. 11 shows the state during the period Δt2. As shown in the figure, the control signals S2 and S4 shift to the "H" level to turn on the switch elements 12 and 31. Consequently, the voltage V2 is input to the inverted input terminal of the operational amplifier 13. The current I2 proportional to the input voltage V2 thus flows through p-channel MOS transistor 14. The current I2 also flows through the p-channel MOS transistor 15, which forms the current mirror circuit together with the p-channel MOS transistor 14. The current I2 also flows through the n-channel MOS transistor 24. Accordingly, the current I2 also flows through the n-channel MOS transistor 25, which forms a current mirror circuit together with the n-channel MOS transistor 24. On the other hand, when the switch element 26 is turned off, a current corresponding to the voltage charged in the capacitor element 28 flows through the p-channel MOS transistor 27. This voltage is charged in the capacitor element 28 during the period Δt1. Consequently, the current I1 flows through the p-channel MOS transistor 27. Then, the current I3=(I1−I2) flows through the resistance element 32. Accordingly, provided that the resistance value of the resistance element 32 is defined as R1, an output voltage V3 is V3=R1·I3=R1·(I1−I2)=R1·((V1/R1)−(V2/R1))=V1−V2. That is, the differential voltage between the input voltages V1 and V2 can be extracted.

According to the present embodiment, a voltage subtraction can be carried out in the order opposite to that in the first and second embodiments. Of course, in the present embodiment, the specified voltage output by the reference voltage generating circuit 40, described with reference to FIG. 5, may be input as the input voltage V2. The voltage output by the voltage converting circuit 70, described with reference to FIG. 7, may be input as the input voltage V1.

Figure 12:
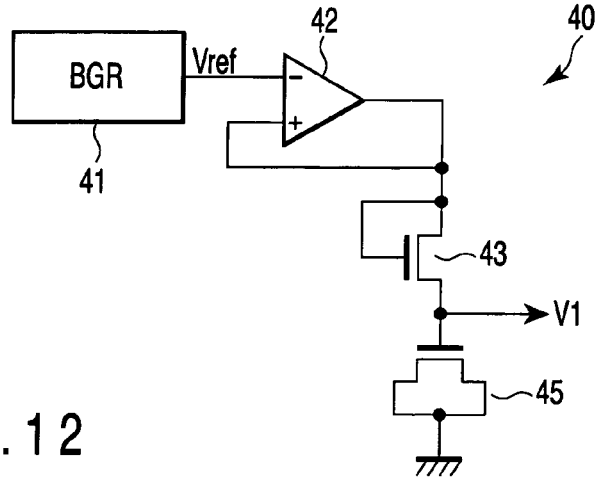
FIG. 12 is a circuit diagram of a reference voltage generator that generates an input voltage to the voltage subtracting circuit according to a variation of the second and third embodiments of the present invention.
Figure 13:
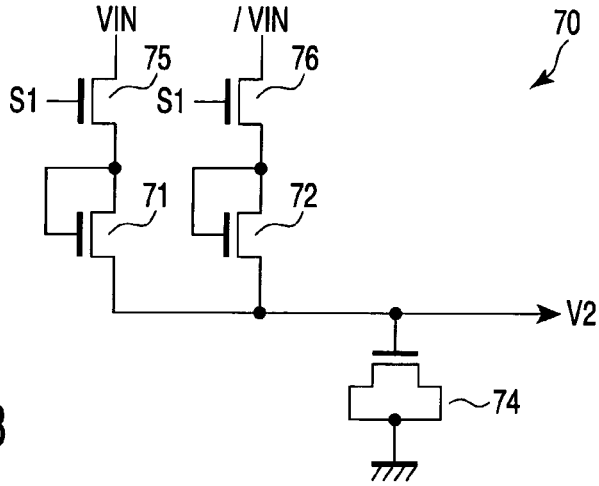
FIG. 13 is a circuit diagram of a reference voltage generator that generates an input voltage to the voltage subtracting circuit according to a variation of the second and third embodiments of the present invention.

FIGS. 12 and 13 are circuit diagrams of the reference voltage generator 40 and voltage converting circuit 70 used in the voltage subtracting circuit 1, according to a variation of the second and third embodiments.

As shown in FIG. 12, in the reference voltage generator 40 configured as shown in FIG. 5, the n-channel MOS transistor 44 may be replaced with an n-channel MOS transistor 45. A source and a drain of the n-channel MOS transistor 45 are connected together and to the ground potential. A gate of the n-channel MOS transistor is connected to the n-channel MOS transistor 43. The connection node between these n-channel MOS transistors outputs a voltage V1.

With the reference voltage generator shown in FIG. 12, the voltage converting circuit shown in FIG. 13 can be used. As shown in FIG. 13, in the voltage converting circuit 70 configured as shown in FIG. 8, an n-channel MOS transistor 73 is omitted, whereas n-channel MOS transistors 75 and 76 are added. The control signal S1 is input to a gate of the n-channel MOS transistor 75. The signal voltage VIN is input to a drain of the n-channel MOS transistor 75. A source of the n-channel MOS transistor 75 is connected to a drain and a gate of an n-channel MOS transistor 71. The control signal S1 is input to a gate of the n-channel MOS transistor 76. The signal voltage/VIN is input to a drain of the n-channel MOS transistor 76. A source of the n-channel MOS transistor 76 is connected to a drain and a gate of an n-channel MOS transistor 72. The signal voltages VIN and/VIN are sampled only during the period Δt1, when the control signal S1 is at the "H" level.

In the configuration shown in FIG. 8, the n-channel MOS transistor 73 may be replaced with a current source circuit.

Figure 14:
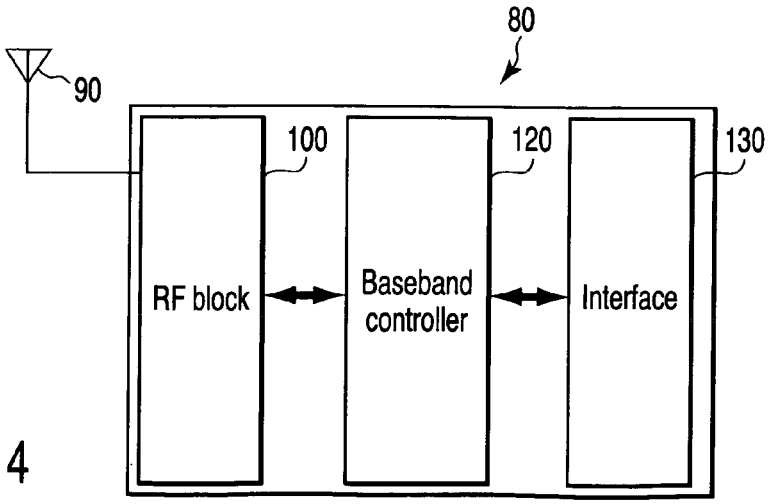
FIG. 14 is a block diagram of a radio communication semiconductor integrated circuit device comprising a voltage subtracting circuit according to a fourth embodiment of the present invention.

Now, description will be given of an intensity detecting circuit using the voltage subtracting circuit according to a fourth embodiment of the present invention. In the present embodiment, the voltage subtracting circuit 1 described in the first to third embodiments is used for an intensity detecting circuit of radio communication semiconductor integrated circuit. FIG. 14 is a block diagram of a radio communication semiconductor integrated circuit according to the present embodiment, for example, a Bluetooth module. As shown in the figure, a Bluetooth module 80 comprises an antenna 90, an RF block 100, a baseband controller 120, and an interface 130.

The antenna 90 transmits and receives radio signals. The baseband controller 120 demodulates and modulates data. The RF block 100 will be described later. The Bluetooth module 80 is connected via the interface 130 to a domestic appliance such as a personal computer, a PDA, a printer, or a television.

Figure 15:
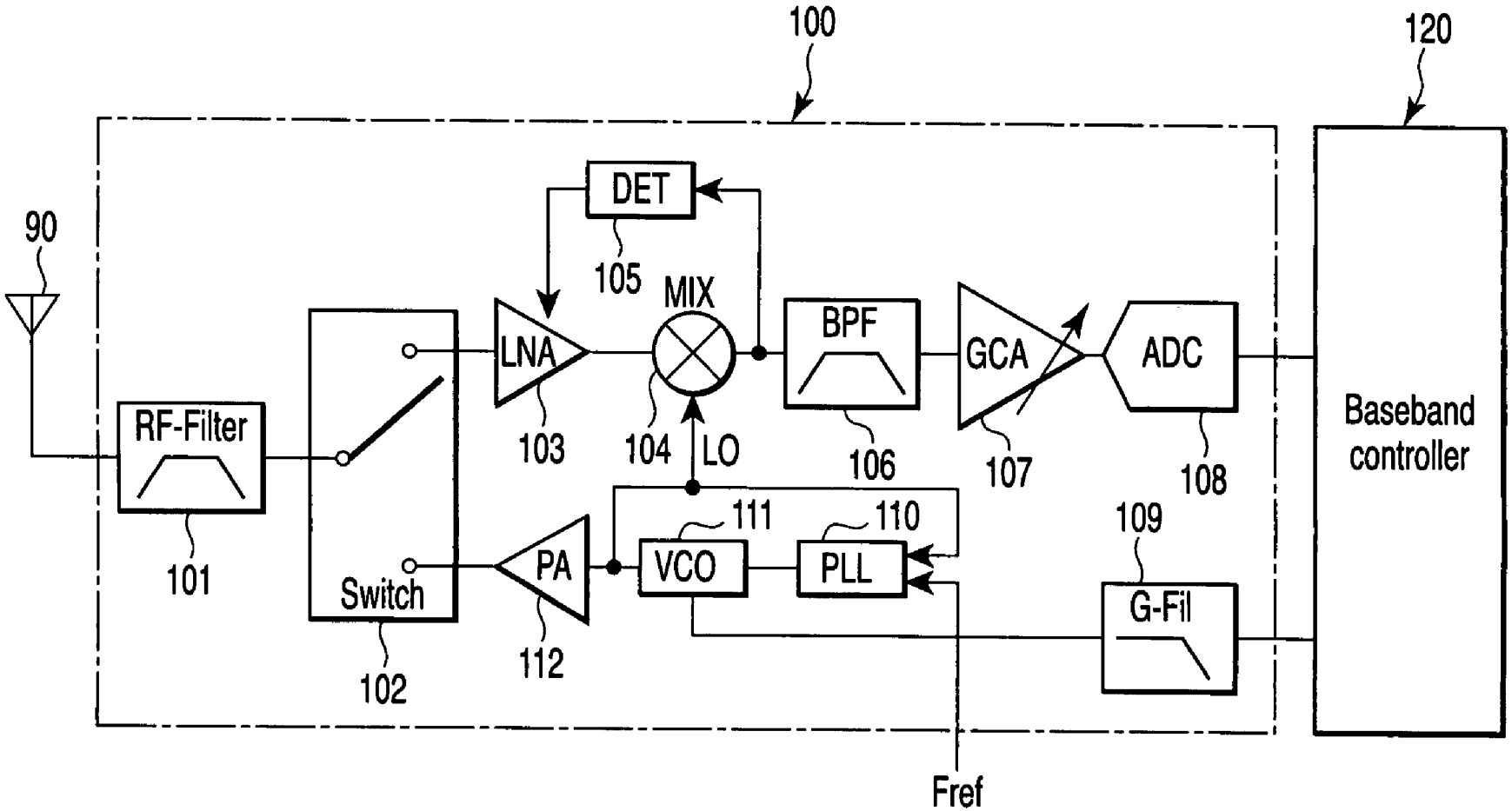
FIG. 15 is a block diagram of the radio communication semiconductor integrated circuit device comprising the voltage subtracting circuit according to the fourth embodiment of the present invention, particularly showing an RF block in detail.

FIG. 15 is a block diagram of the RF block 100. As shown in the figure, the RF block 100 comprises an RF filter 101, an RF switch 102, a low noise amplifier 103, a mixer 104, an intensity detecting circuit 105, a bandpass filter 106, a gain control amplifier 107, an A/D converter 108, Gaussian low pass filter 109, a PLL (Phase Locked Loop) circuit 110, a voltage control oscillating circuit 111, and a power amplifier 112.

For a data reception, an incoming radio carrier signal (hereinafter referred to as an RF signal) is received by the antenna 90 and then loaded into the RF block 100 via the RF filter 101. The switch 102 sends the RF signal to the low noise amplifier 103. The low noise amplifier 103 amplifies the signal intensity of the RF signal. The mixer 104 then mixes the RF signal amplified by the low noise amplifier 103 with a local signal LO output by the voltage control oscillating circuit 111. Thus, the signals are down-converted to an intermediate frequency IF. The band pass filter 106 allows the passage of only a specified channel frequency band within the RF signal (IF signal) resulting from the down-conversion to the intermediate frequency (IF). Then, the gain control amplifier 107 controls the IF signal passing through the band pass filter 106 so that its signal amplitude falls within the dynamic range of the A/D converter 108. Then, the A/D converter 108 converts the IF signal into a digital signal. The IF signal sampled by the A/D converter 108 is sent to the baseband controller 120, which executes a baseband process. The baseband controller 120 then demodulates the IF signal. The intensity detecting circuit 105 controls the degree of amplification in the low noise amplifier 103 in accordance with the intensity of the IF signal.

On the other hand, for a data transmission, the baseband controller 120 transfers digital data to the Gaussian low pass filter 109. The Gaussian low pass filter 109 suppresses a high frequency component of the digital data. Then, an output from the Gaussian low pass filter 109 is sent to a modulation terminal of the voltage control oscillating circuit 111. The voltage control oscillating circuit 111 modulates the output frequency of an oscillation signal. The PLL circuit 110 presets the output frequency of the voltage control oscillating circuit 111 at a predetermined channel frequency. The power amplifier 112 amplifies an oscillation signal output by the voltage control oscillating circuit 111, to a desired power. The antenna 90 transmits the resultant signal via the RF switch 102 and the RF filter 101.

Figure 16:
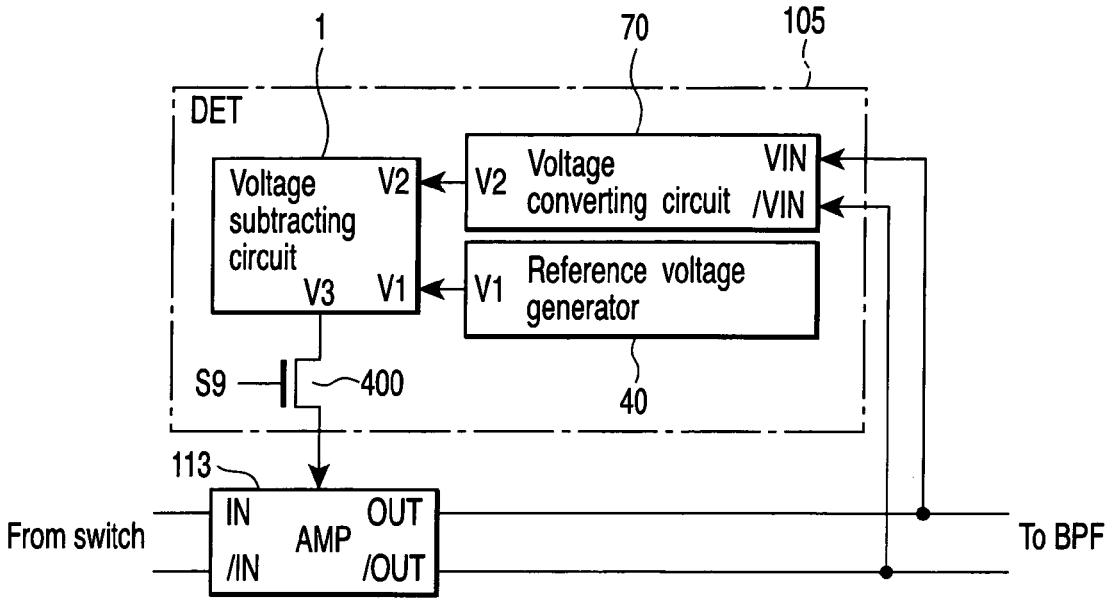
FIG. 16 is a block diagram of an intensity detecting circuit according to the fourth embodiment of the present invention.

FIG. 16 is a block diagram showing the configuration of the intensity detecting circuit 105 in FIG. 15. FIG. 16 shows an amplification circuit 113 including the low noise amplifier 103 and the mixer 104 connected together. In a radio communication system, the intensity of an electric wave varies significantly depending on the distance between a transmitter and a receiver. Thus, the intensity detecting circuit 105 adjusts the amplification factor of the amplifier 113 in accordance with the intensity of a received signal to stabilize the signal intensity of the IF signal.

The intensity detecting circuit 105 comprises the voltage subtracting circuit 1 described in the first to third embodiment, the reference voltage generating circuit 40 and voltage converting circuit 70 described in the second and third embodiments, and an n-channel MOS transistor 400. The configurations of the voltage subtracting circuit 1, reference voltage generator 40, and voltage converting circuit 70 are as described in the first to third embodiments, so that their description is omitted. An output signal OUT from the amplification circuit 113 is input to the voltage converting circuit 70 as the signal voltage VIN. An inverted output signal/OUT from the amplification circuit 113 is input to the voltage converting circuit 70 as the inverted signal voltage/VIN. The output voltage V3 from the voltage subtracting circuit 1 is output via a current path of the n-channel MOS transistor 400 as a control signal CNT. The control signal CNT is provided to the amplification circuit 113. A control signal S9 is input to a gate of the n-channel MOS transistor 400.

Figure 17:
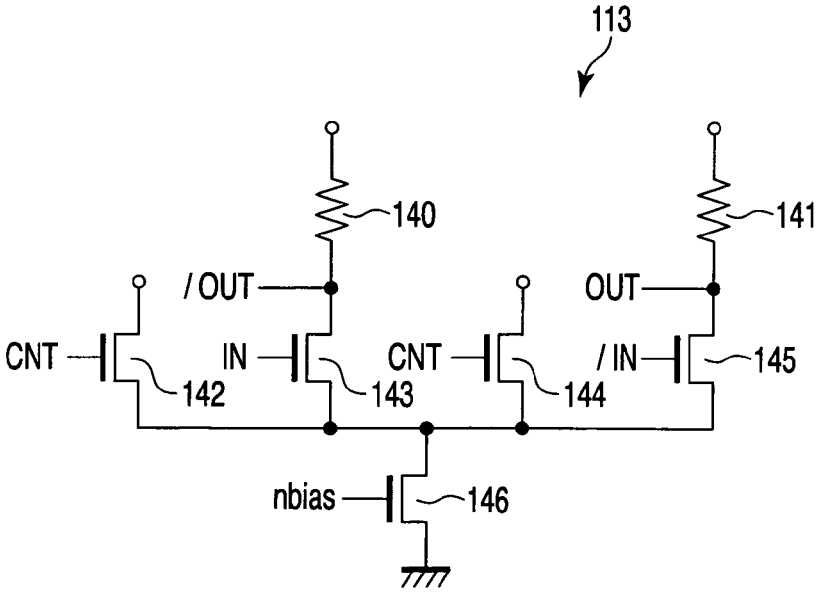
FIG. 17 is a circuit diagram of an amplification circuit according to the fourth embodiment of the present invention.

FIG. 17 is a circuit diagram showing an example of the configuration of the amplification circuit 113. As shown in the figure, the amplification circuit 113 comprises resistance elements 140 and 141 and n-channel MOS transistors 142 to 146. One end of each of the resistance elements 140 and 141 is connected to the power supply potential. The other ends of the resistance elements 140 and 141 are connected to drains of the n-channel MOS transistors 143 and 145. Gates of the n-channel MOS transistors 143 and 145 are connected to input terminals IN and/IN, respectively, of the amplification circuit 113. An RF signal and an inverted RF signal are input to the input terminals IN and/IN. Drains of the n-channel MOS transistor 142 and 144 are connected to the power supply voltage. The control signal CNT is input to gates of the N channel MOS transistors 142 and 144. Sources of the n-channel MOS transistors 142 to 145 are connected together. The voltage nbias is applied to a gate of the n-channel MOS transistor 146. A source of the n-channel MOS transistor 146 is grounded. A drain of the n-channel MOS transistor 146 is connected to the sources of the n-channel MOS transistors 142 to 145. In the amplification circuit 113 configured as described above, the potential of the connection node between the resistance element 141 and the n-channel MOS transistor 145 is an output signal OUT (IF signal) from the amplification circuit 113. The potential of the connection node between the resistance element 140 and the n-channel MOS transistor 143 is an inverted output signal/OUT from the amplification circuit 113.

Figure 18:
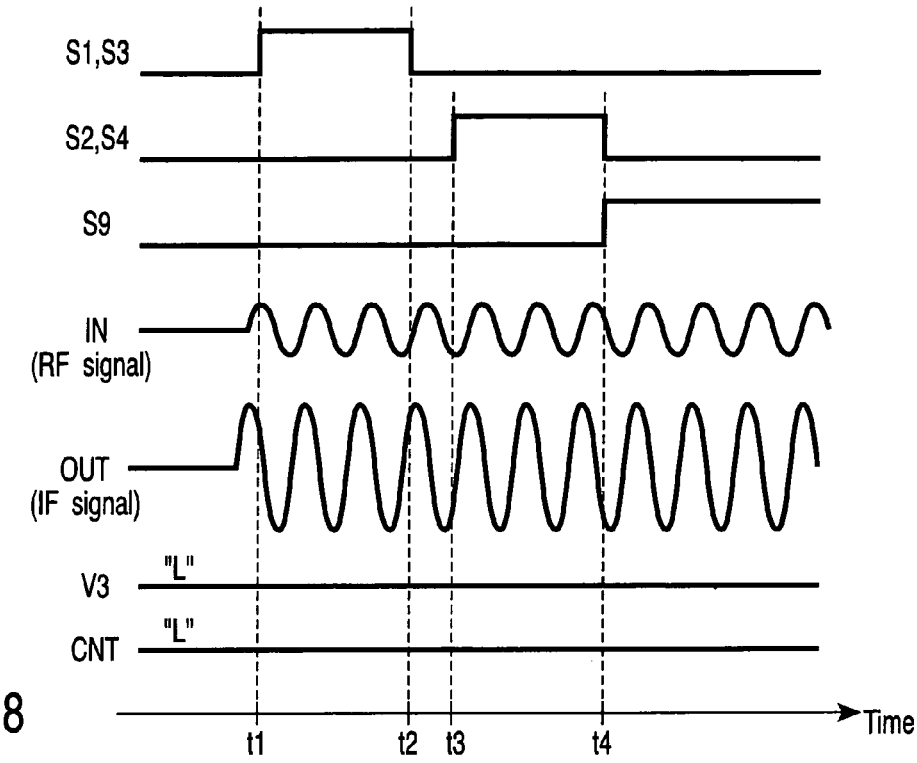
FIG. 18 is a timing chart of various signals in the radio communication semiconductor integrated circuit according to the fourth embodiment of the present invention, showing the case in which RF signals have relatively low intensities.
Figure 19:
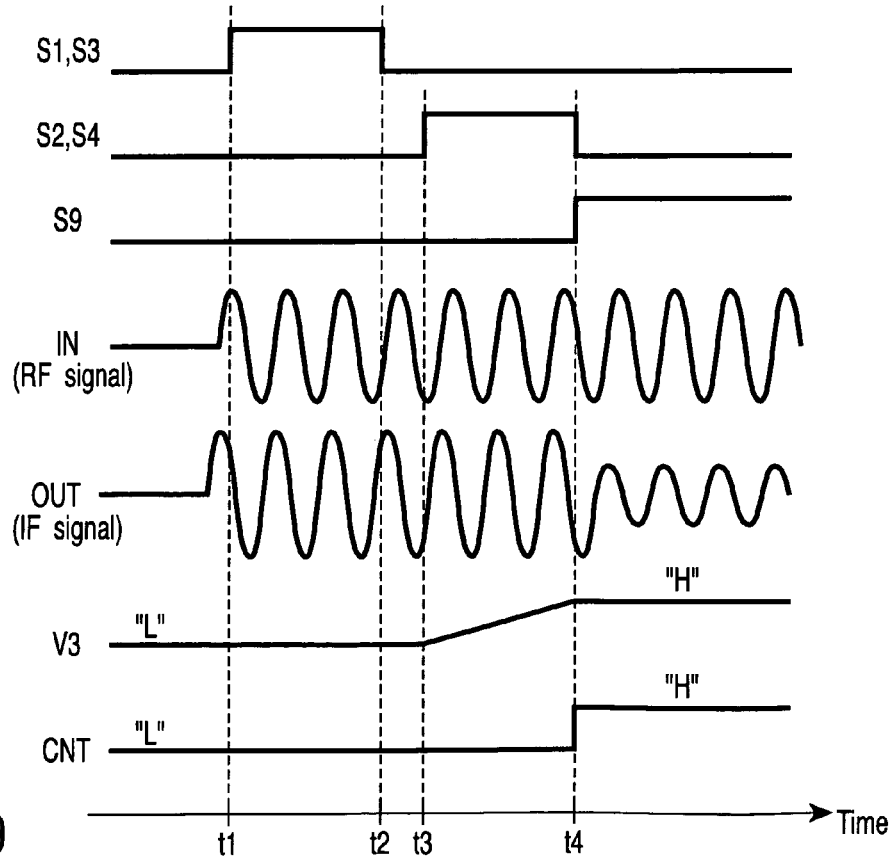
FIG. 19 is a timing chart of various signals in the radio communication semiconductor integrated circuit according to the fourth embodiment of the present invention, showing the case in which the RF signals have relatively high intensities.

With reference to FIGS. 18 and 19, description will be given of operations of the intensity detecting circuit 105 and amplification circuit 113 configured as described above. FIGS. 18 and 19 are timing charts of the control signals S1 to S4 and S9, the RF signal, the IF signal, the result of a voltage subtraction V3, and the control signal CNT. FIG. 18 shows the case in which the amplitude of the RF signal is not larger than a specified value (V2<V1). FIG. 19 shows the case in which the amplitude of the RF signal is larger than the specified value (V2>V1).

As shown in the figure, at the time t1, the control signals S1 and S3 shift to the "H" level. The voltage subtracting circuit 1 loads one of the RF signal resulting from the conversion by the voltage converging circuit 70 and the specified voltage generated by the reference voltage generator 40. Then, at the time t3, the control signals S2 and S4 shift to the "H" level. The other of the RF signal and the specified voltage is loaded into the voltage subtracting circuit 1. The voltage subtracting circuit 1 then carries out a subtraction on the RF signal and the specified voltage. FIG. 18 shows the case in which the amplitude of the RF signal does not exceed the specified voltage generated by the reference voltage generator 40. Accordingly, the output voltage V3 from the voltage subtracting circuit 1 shifts to the "L" level. At the time t4, the control signal S9 shifts to the "H" level. The voltage V3 is provided to the amplification circuit 113 as the control signal CNT. The amplification circuit 113 sets a large amplification factor when the control signal CNT is at the "L" level. The amplification circuit 113 sets a small amplification factor when the control signal CNT is at the "H" level. Accordingly, in the example shown in FIG. 18, the amplification circuit 113 amplifies the RF signal using the maximum amplification factor.

Now, the case shown in FIG. 19 will be describe. In the present example, the RF signal has a high intensity. The RF signal resulting from the conversion by the voltage converting circuit 70 exceeds the specified voltage generated by the reference voltage generating circuit 40 (V2>V1). Consequently, the output voltage V3 from the voltage subtracting circuit 1 shifts from the "L" level to the "H" level. Thus, at the time t4, the control signal CNT also shifts from the "L" level to the "H" level. As a result, the amplification circuit 113 reduces the amplification factor for the RF signal compared to the case shown in FIG. 18. This prevents the excessive amplitude of the IF signal output by the amplification circuit 113.

With the radio communication semiconductor integrated circuit according to the present embodiment, if the RF signal has a high intensity, the intensity detecting circuit 105 senses this to perform control such that the amplification factor of the amplification circuit 113 is reduced. In contrast, if the RF signal has a low intensity, the intensity detecting circuit 105 performs control such that the amplification factor of the amplification circuit 113 is reduced. Accordingly, the IF signal intensity can always be fixed to improve the operational performance of the radio communication semiconductor integrated circuit. The voltage subtracting circuit 1 described in the first to fourth embodiments is provided in the intensity detecting circuit 105 provided in the radio communication semiconductor integrated circuit according to the present embodiment. That is, the result of a voltage subtraction is unlikely to be affected by a variation in process or temperature. Therefore, the amplification circuit 113 can be accurately controlled.

Figure 20:
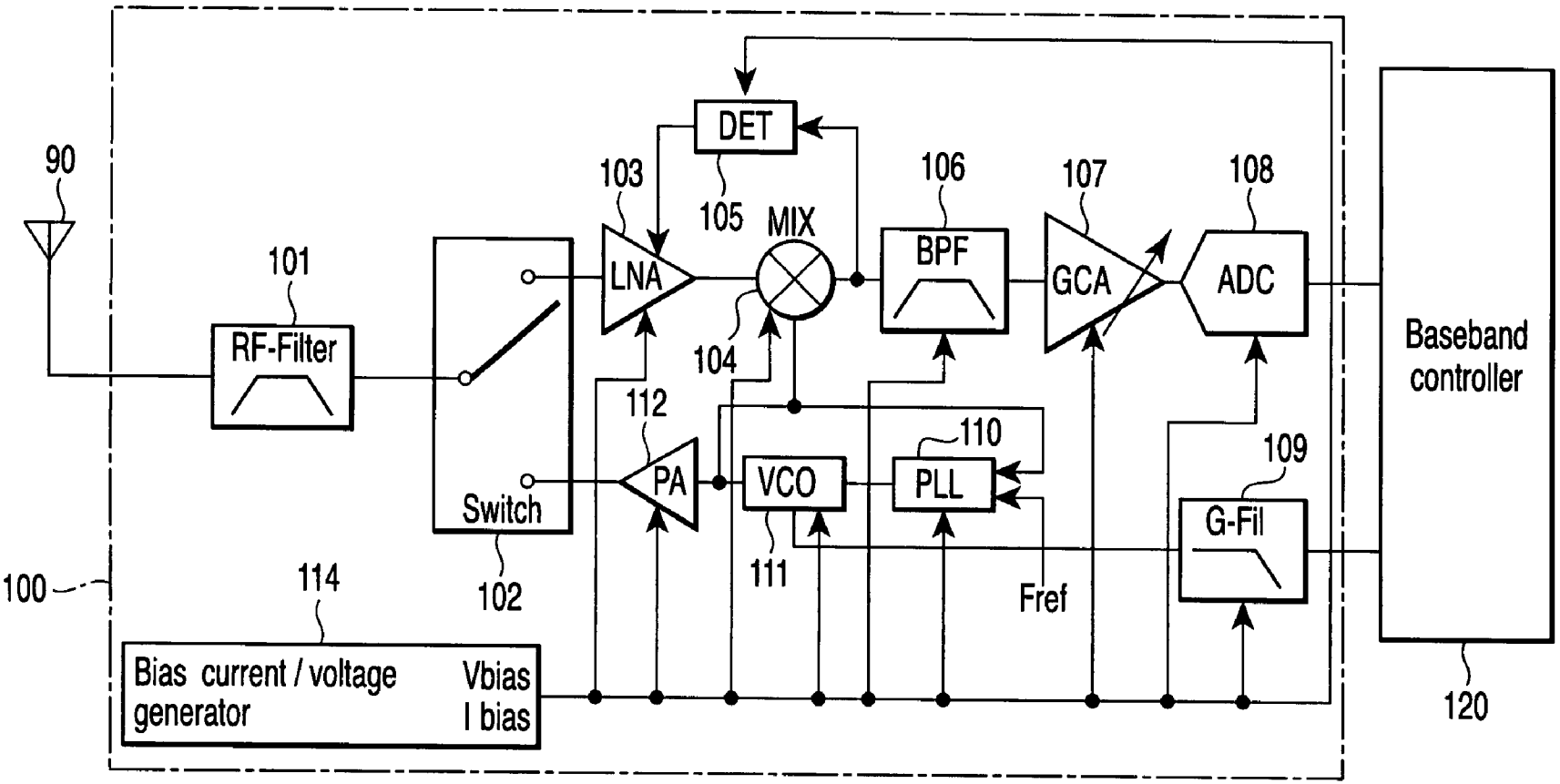
FIG. 20 is a block diagram of a radio communication semiconductor integrated circuit device comprising the voltage subtracting circuit according to a fifth embodiment of the present invention, particularly showing an RF block in detail.

Now, description will be given of a radio communication semiconductor integrated circuit comprising an intensity detecting circuit using the voltage subtracting circuit according to a fifth embodiment of the present invention. The present embodiment relates to a technique for preventing the operational characteristics of the radio communication semiconductor integrated circuit from depending on the temperature by providing each circuit in the radio communication semiconductor integrated circuit with a current and voltage having a predetermined temperature characteristic (or having no temperature characteristic). FIG. 20 is a block diagram of the radio communication semiconductor integrated circuit according to the present embodiment, that is, a Bluetooth module.

As shown in the figure, the configuration of a Bluetooth module 80 corresponds to the configuration in FIG. 15 described in the fourth embodiment and to which a bias current/voltage generator 114 is added. Each circuit in the RF block 100 operates using a bias current and a bias voltage supplied by the bias current/voltage generator 114.

Figure 21:
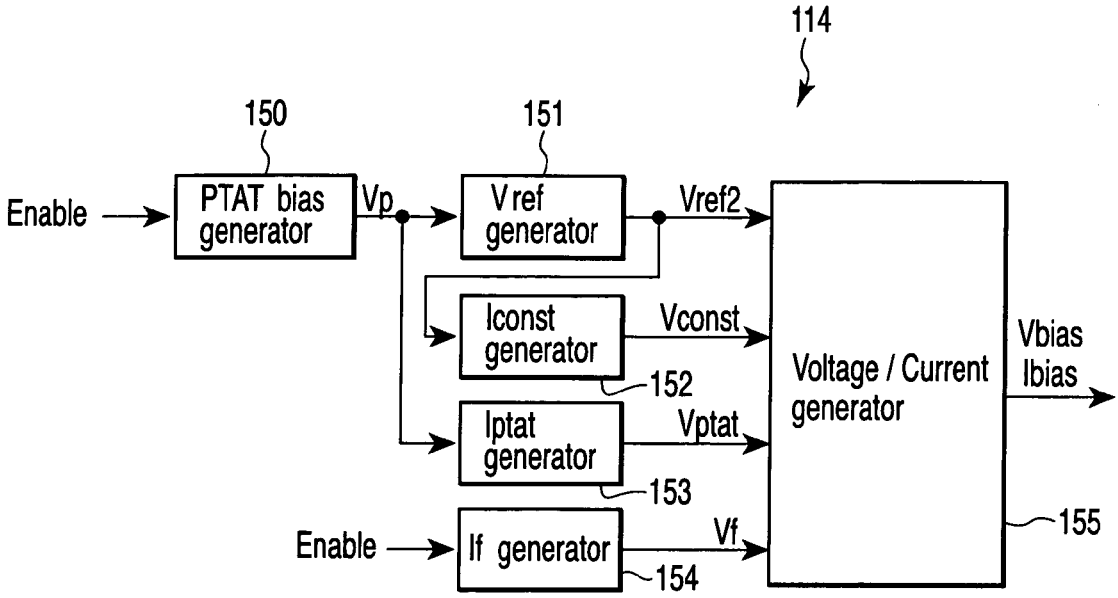
FIG. 21 is a block diagram of a bias current/voltage generator provided in the radio communication semiconductor integrated circuit according to the fifth embodiment of the present invention.

FIG. 21 is a block diagram of the bias current/voltage generator 114. As shown in the figure, the bias current/voltage generator 114 comprises a PTAT (Proportional To Absolute Temperature) bias generator 150, a reference voltage generator 151, an Iconst generator 152, an Iptat generator 153, an If generator 154, and a voltage/current generator 155.

The PTAT bias generator 150 generates a voltage Vp on the basis of an enable signal. The reference voltage generator 151 generates a predetermined reference voltage Vref2 on the basis of the voltage Vp generated by the PATA bias generator 150. The Iconst generator 152 generates a constant voltage Vconst on the basis of the reference voltage Vref2. The Iptat generator 153 generates a voltage Vptat having a predetermined temperature characteristic on the basis of the voltage Vp. The If generator 154 generates a voltage Vf having a predetermined temperature characteristic on the basis of the enable signal. The voltage/current generator 155 generates a bias voltage Vbias and a bias current Ibias on the basis of the voltages Vref2, Vconst, Vptat, and Vf.

Figure 22:
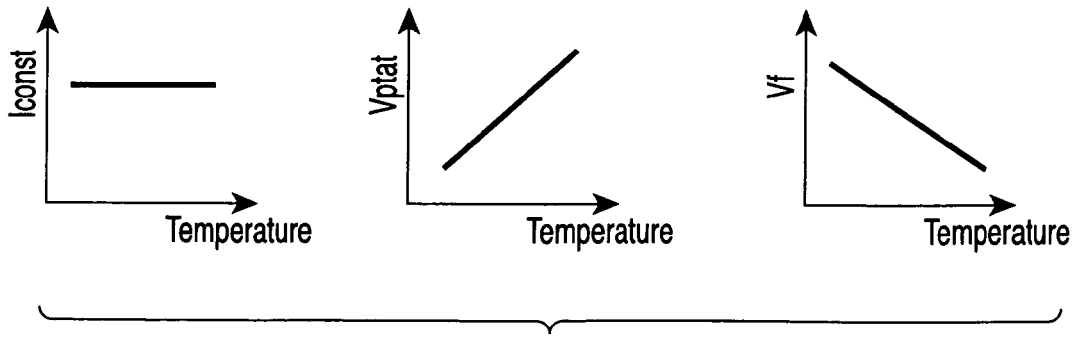
FIG. 22 is a graph showing temperature characteristics of a current and voltage generated by the bias current/voltage generator according to the fifth embodiment of the present invention.

FIG. 22 is a graph showing a variation in temperature for Iconst, Vptat, and Vf. As shown in the figure, the temperature characteristics are such that Iconst is almost constant regardless of the temperature and that Vptat increases with the temperature, whereas Vf decreases with the temperature.

Figure 23:
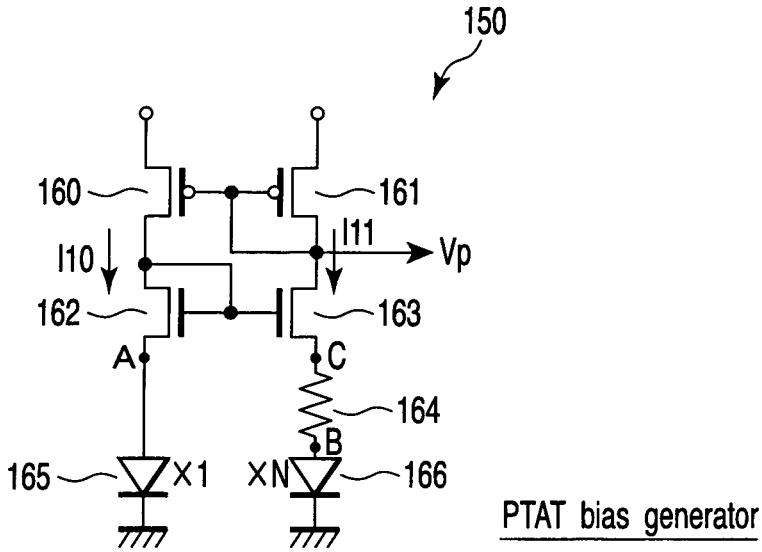
FIG. 23 is a circuit diagram of a PTAT bias generator provided in the radio communication semiconductor integrated circuit according to the fifth embodiment of the present invention.

FIG. 23 is a circuit diagram of the PTAT bias generator 150. As shown in the figure, the PTAT bias generator 150 comprises p-channel MOS transistors 160 and 161, n-channel MOS transistors 162 and 163, a resistance element 164, and diodes 165 and 166. Gates of the p-channel MOS transistors 160 and 161 are connected together. Sources of the p-channel MOS transistors 160 and 161 are connected to the power supply potential. A gate of the p-channel MOS transistor 161 is connected to a drain of the p-channel MOS transistor 161. Gates of the n-channel MOS transistors 162 and 163 are connected together. Drains of the n-channel MOS transistors 162 and 163 are connected to the drains of the p-channel MOS transistors 160 and 161, respectively. Further, a gate of the n-channel MOS transistor 162 is connected to the drain of the n-channel MOS transistor 162. The diode 165 is connected between a source of the n-channel MOS transistor 162 and the ground potential. A source of the n-channel MOS transistor 163 is connected to one end of the resistance element 164. The other end of the resistance element 164 is connected to anodes of N (N is a natural number) diodes 166. Cathodes of the diodes 166 are connected to the ground potential.

In FIG. 23, the potentials at points A, B, and C are defined as V10, V11, and V12. Further, each of the n-channel MOS transistors 162 and 163 has the same size as the p-channel MOS transistors 160 and 161. Then the following equations are established.

$$I10=Is\cdot\exp(V10/VT)$$

$$I11=N\cdot Is\cdot\exp(V11/VT)$$

In these equations, Is denotes a current proportion coefficient proportional to the junction area of a pn junction of diodes. VT is represented by kT/q (k: Boltzmann constant, T: temperature, q: electric charge) and is a voltage constant proportional to the temperature. The following equation is thus derived.

$$I10-I11=VT\cdot ln(N)$$

Further, provided that the resistance value of the resistance element 164 is defined as R2 and an absolute temperature is defined as T, the following equation is given.

$$\begin{aligned} I11 &= (V12-V11)/R2 = (V10-V11)/R2 \\ &= VT\cdot\ln(N)/R = [k\cdot\ln(N)/R]\cdot T \end{aligned}$$

That is, an operating current for the PTAT bias generator 150 is proportional to the absolute temperature T.

Figure 24:
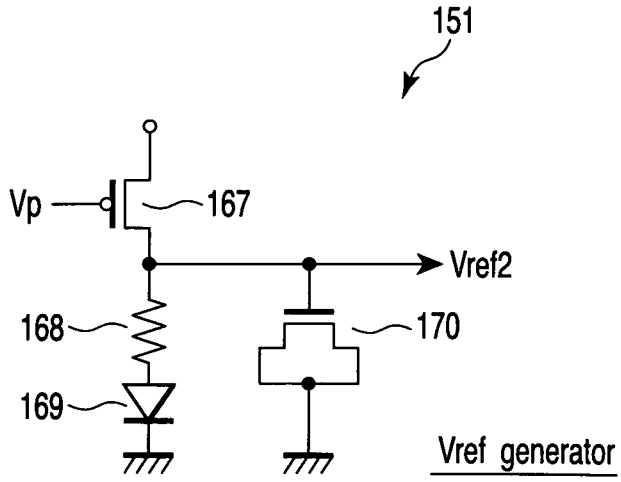
FIG. 24 is a circuit diagram of a reference voltage generator provided in the radio communication semiconductor integrated circuit according to the fifth embodiment of the present invention.

FIG. 24 is a circuit diagram of the reference voltage generator 151. The reference voltage generator 151 is a band gap reference circuit generating a voltage Vref2 that is not substantially dependent on the temperature on the basis of the voltage Vp output by the PTAT bias generator 150.

As shown in the figure, the reference voltage generator 151 comprises a p-channel MOS transistor 167, a resistance element 168, a diode 169, and an n-channel MOS transistor 170. The voltage Vp is applied to a gate of the p-channel MOS transistor 167. A source of the p-channel MOS transistor 167 is connected to the power supply potential. One end of the reference element 168 is connected to a drain of the p-channel MOS transistor 167. An anode of the diode 169 is connected to the other end of the resistance element 168. A cathode of the diode 169 is grounded. Further, a gate of the n-channel MOS transistor 170 is connected to the connection node between the p-channel MOS transistor 167 and the resistance element 168. A source and a drain of the n-channel MOS transistor 170 are connected together and grounded. The voltage Vref2 is output from the connection node between the p-channel MOS transistor 167 and the resistance element 168.

Figure 25:
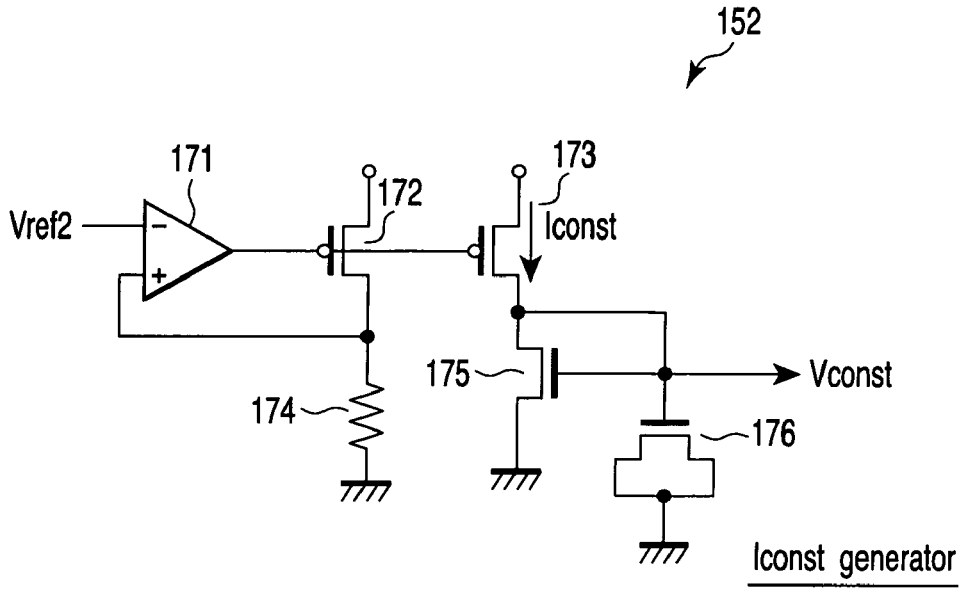
FIG. 25 is a circuit diagram of an Iconst generator provided in the radio communication semiconductor integrated circuit according to the fifth embodiment of the present invention.

FIG. 25 is a circuit diagram of the Iconst generator 152. The Iconst generator 152 generates a constant current Iconst on the basis of the voltage Vref2. The Iconst generator 152 comprises an operational amplifier 171, p-channel MOS transistors 172 and 173, a resistance element 174, and n-channel MOS transistors 175 and 176. The voltage Vref2 is applied to an inverted input terminal of the operational amplifier 171. Gates of the p-channel MOS transistors 172 and 173 are connected together to form a current mirror circuit. The gates of the p-channel MOS transistors 172 and 173 are connected to an output terminal of the operational amplifier 171. Sources of the p-channel MOS transistors 172 and 173 are connected to the power supply potential. A drain of the p-channel MOS transistor 172 is connected to a normal input terminal of the operational amplifier 171 and to one end of the resistance element 174. The other end of the resistance element 174 is connected to the ground potential. A gate and a drain of the n-channel MOS transistor 175 are connected to a drain of the p-channel MOS transistor 173. A source of the n-channel MOS transistor 175 is grounded. A gate of the n-channel MOS transistor 176 is connected to the gate of the n-channel MOS transistor 175. A source and a drain of the n-channel MOS transistor 176 are connected together and grounded. In the above configuration, the constant voltage Iconst corresponding to the voltage Vref2 flows through the p-channel MOS transistor 173. The potential of the drain of the p-channel MOS transistor 173 is thus output as the constant voltage Vconst.

Figure 26:
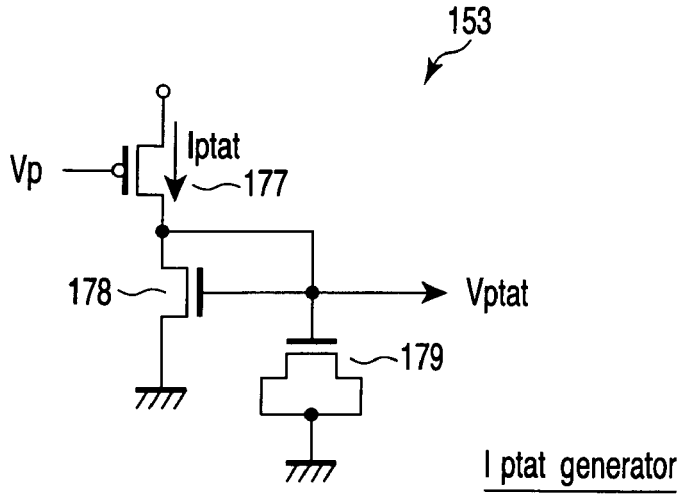
FIG. 26 is a circuit diagram of an Iptat generator provided in the radio communication semiconductor integrated circuit according to the fifth embodiment of the present invention.

FIG. 26 is a circuit diagram of the Iptat generator 153. The Iptat generator 153 is a level converting circuit for the voltage Vp to regenerate a current Iptat. The Iptat generator 153 comprises a p-channel MOS transistor 177 and n-channel MOS transistors 178 and 179. The voltage Vp is applied to a gate of the p-channel MOS transistor 177. A source of the p-channel MOS transistor 177 is connected to the power supply potential. A gate and a drain of the n-channel MOS transistor 178 are connected to a drain of the p-channel MOS transistor 177. A source of the n-channel MOS transistor 178 is grounded. A gate of the n-channel MOS transistor 179 is connected to the gate of the n-channel MOS transistor 178. A source and a drain of the n-channel MOS transistor 179 are connected together and grounded. The p-channel MOS transistor 177 supplies the current Iptat corresponding to the voltage Vp. The potential of the drain of the p-channel MOS transistor 177 is output as the voltage Vptat.

Figure 27:
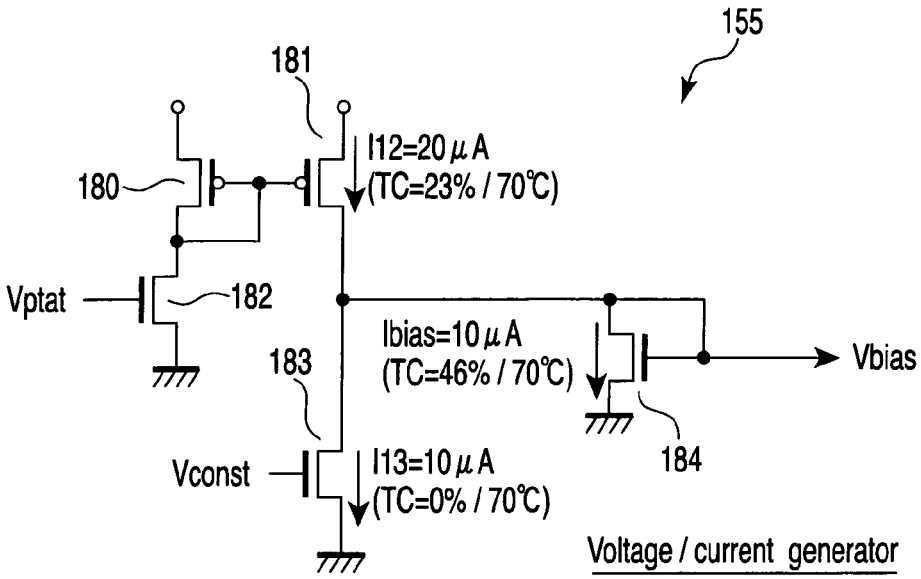
FIG. 27 is a circuit diagram of a voltage/current generator provided in the radio communication semiconductor integrated circuit according to the fifth embodiment of the present invention.
Figure 28:
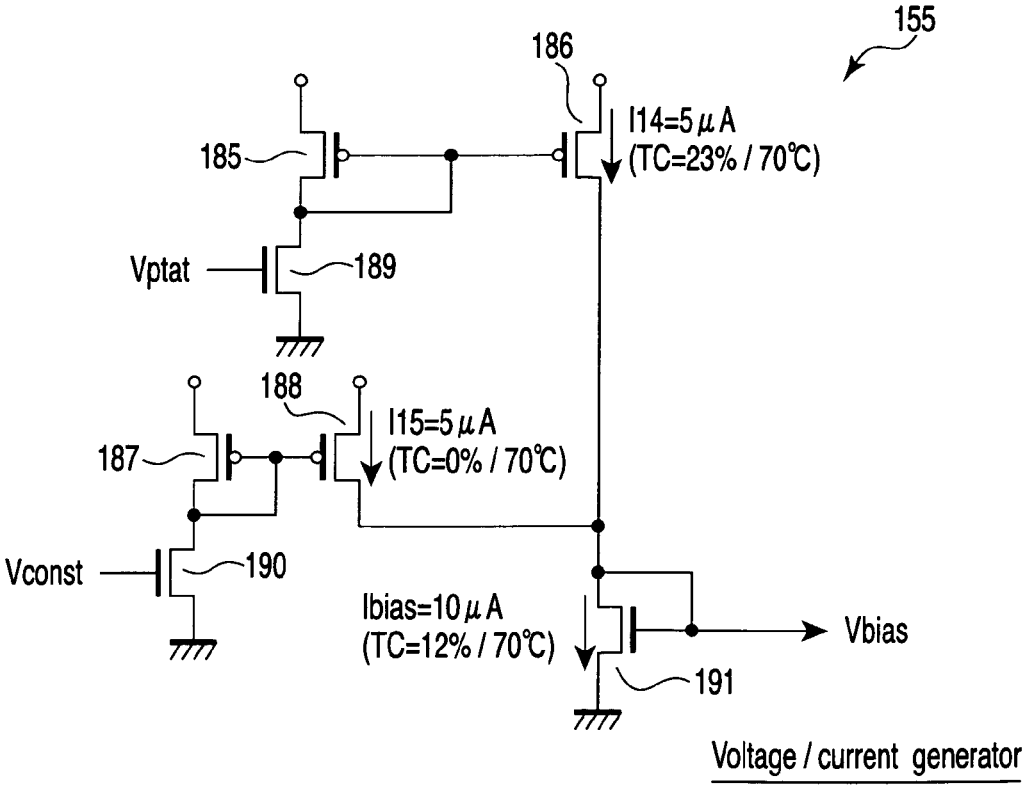
FIG. 28 is a circuit diagram of a voltage/current generator provided in the radio communication semiconductor integrated circuit according to the fifth embodiment of the present invention.
Figure 29:
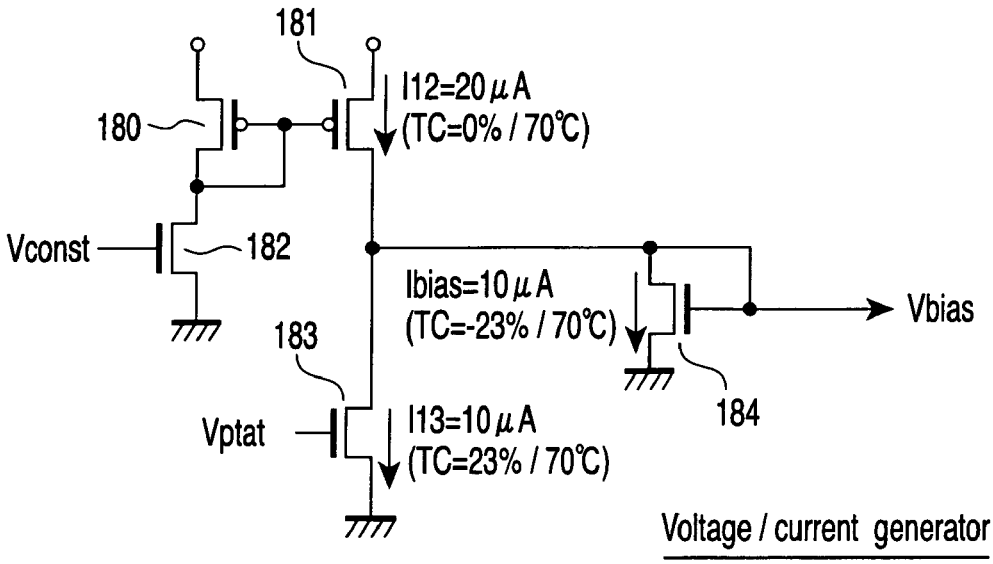
FIG. 29 is a circuit diagram of a voltage/current generator provided in the radio communication semiconductor integrated circuit according to the fifth embodiment of the present invention.

FIGS. 27 to 29 are circuit diagrams of the voltage/current generator 155. Each voltage/current generator 155 outputs a current Ibias having a corresponding temperature coefficient TC. FIG. 27 shows the voltage/current generator 155 generating a current Ibias which is proportional to the absolute temperature and which has a relatively large proportion coefficient (TC=46%/70° C.). FIG. 28 shows the voltage/current generator 155 generating a current Ibias which is proportional to the absolute temperature and which has a relatively small proportion coefficient (TC=12%/70° C.).

FIG. 29 shows the voltage/current generator 155 generating a current Ibias which is proportional to the absolute temperature and which has a negative proportion coefficient (TC=−23%/70° C.).

First, description will be given of the configuration of the voltage/current generator 155 shown in FIG. 27. The voltage/current generator 155 comprises p-channel MOS transistors 180 and 181 and n-channel MOS transistors 182 to 184. Sources of the p-channel MOS transistors 180 and 181 are connected to the power supply potential. Gates of the p-channel MOS transistors 180 and 181 are connected together to form a current mirror circuit. A drain of the p-channel MOS transistor 180 is connected to a gate of the p-channel MOS transistor 180 and to a drain of the n-channel MOS transistor 182. The voltage Vptat is applied to a gate of the n-channel MOS transistor 182. A source of the n-channel MOS transistor 182 is grounded. A drain of the n-channel MOS transistor 183 is connected to a drain of the p-channel MOS transistor 181. The voltage Vconst is applied to a gate of the n-channel MOS transistor 183. A source of the n-channel MOS transistor 183 is grounded. A gate and a drain of the n-channel MOS transistor 184 are connected to the drain of the p-channel MOS transistor 181. A source of the n-channel MOS transistor 184 is grounded.

The p-channel MOS transistor 181 supplies a current I12 in response to the voltage Vptat. The current I12 has a temperature dependence TC=23%/70° C. The n-channel MOS transistor 183 supplies a current I13 in response to the voltage Vconst. The current I13 has a temperature dependence TC=0%/70° C. That is, the current I13 is constant relative to the temperature. The n-channel MOS transistor 184 supplies a current Ibias. The current Ibias has a temperature dependence TC=46%/70° C. The voltage of the gate and drain of the n-channel MOS transistor 184 is output as the voltage Vbias. As described above, the configuration shown in FIG. 27 provides the current Ibias, which has a temperature characteristic such that the current value increases by 46% when the temperature increases by 70° C.

Next, description will be given of the configuration of the voltage/current generator 155 shown in FIG. 28. The voltage/current generator 155 comprises p-channel MOS transistors 185 to 188 and n-channel MOS transistors 189 to 191. Sources of the p-channel MOS transistors 185 and 186 are connected to the power supply potential. Gates of the p-channel MOS transistors 185 and 186 are connected together to form a current mirror circuit. A drain of the p-channel MOS transistor 185 is connected to a gate of the p-channel MOS transistor 185 and to a drain of the n-channel MOS transistor 189. The voltage Vptat is applied to a gate of the n-channel MOS transistor 189. A source of the n-channel MOS transistor 189 is grounded. Sources of p-channel MOS transistors 187 and 188 are connected to the power supply potential. Gates of the n-channel MOS transistor 187 and 188 are connected together to form a current mirror circuit. A drain of the n-channel MOS transistor 187 is connected to a gate of the p-channel MOS transistor 187 and to a drain of the n-channel MOS transistor 190. The voltage Vconst is applied to a gate of the n-channel MOS transistor 190. A source of the n-channel MOS transistor 190 is grounded. A drain of the n-channel MOS transistor 191 is connected to drains of the p-channel MOS transistors 186 and 188 and to a gate of the n-channel MOS transistor 191. A source of the n-channel MOS transistor 191 is grounded.

The p-channel MOS transistor 186 supplies a current I14 in response to the voltage Vptat. The current I14 has a temperature dependence TC=23%/70° C. The p-channel MOS transistor 188 supplies a current I15 in response to the voltage Vconst. The current I15 has a temperature dependence TC=0%/70° C. The n-channel MOS transistor 191 supplies a current Ibias. The current Ibias has a temperature dependence TC=12%/70° C. The voltage of the gate and drain of the n-channel MOS transistor 191 is output as the voltage Vbias. As described above, the configuration shown in FIG. 28 provides the current Ibias, which has a temperature characteristic such that the current value increases by 12% when the temperature increases by 70° C.

Next, description will be given of the configuration of the voltage/current generator 155 shown in FIG. 29. The voltage/current generator 155 shown in FIG. 29 has the same circuit configuration as that of the voltage/current generator 155 shown in FIG. 27. However, the voltage Vconst is applied to the gate of the n-channel MOS transistor 182. The voltage Vptat is applied to the gate of the n-channel MOS transistor 183. The temperature dependence of the voltage I12, supplied by the n-channel MOS transistor 181, is TC=0%/70° C. The temperature dependence of the voltage I13, supplied by the n-channel MOS transistor 183, is TC=23%/70° C. As a result, the temperature dependence of the voltage Ibias, supplied by the n-channel MOS transistor 184, is TC=−23%/70° C.

Figure 30:
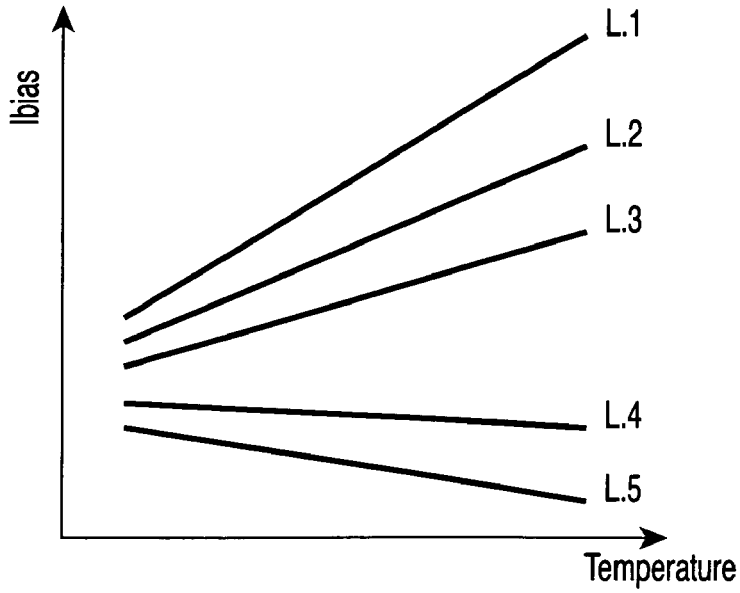
FIG. 30 is a graph showing the relationship between temperature and a current Ibias generated by the voltage/current generator provided in the radio communication semiconductor integrated circuit according to the fifth embodiment of the present invention.

As described above, it is possible to generate currents Ibias having the respective temperature dependences. FIG. 30 shows the temperature dependence of Ibias. L.1 to L.5 denote the case of the temperature coefficient TC≧TC0 (=23%/70° C.), the case of the temperature coefficient TC=TC0, the case of the temperature coefficient TC<TC0, the case of the temperature coefficient TC nearly equal to 0, and the case of the temperature coefficient TC<0, respectively. In this manner, the use of Vptat, Vconst, and Vref2 enables the generation of currents Ibias having various temperature dependences.

As described above, the radio communication semiconductor integrated circuit according to the present embodiment supplies each circuit block with a current having the desired temperature characteristic. Consequently, by optimizing the temperature characteristic of a supplied current, it is possible to offset the temperature characteristic of each circuit block. Therefore, the radio communication semiconductor integrated circuit can always perform fixed operations without being affected by the temperature. This improves the operational accuracy of the radio communication semiconductor integrated circuit.

Now, description will be given of a radio communication semiconductor integrated circuit comprising an intensity detecting circuit using the voltage subtracting circuit according to a sixth embodiment of the present invention. In the present embodiment, the bias current/voltage generator 114 described in the fifth embodiment is applied to the case of several power supply pads. FIGS. 31 to 34 are circuit diagrams of the PTAT bias generator 150, reference voltage generator 151, Iconst generator 152, and Iptat generator 153, respectively.

Figure 31:
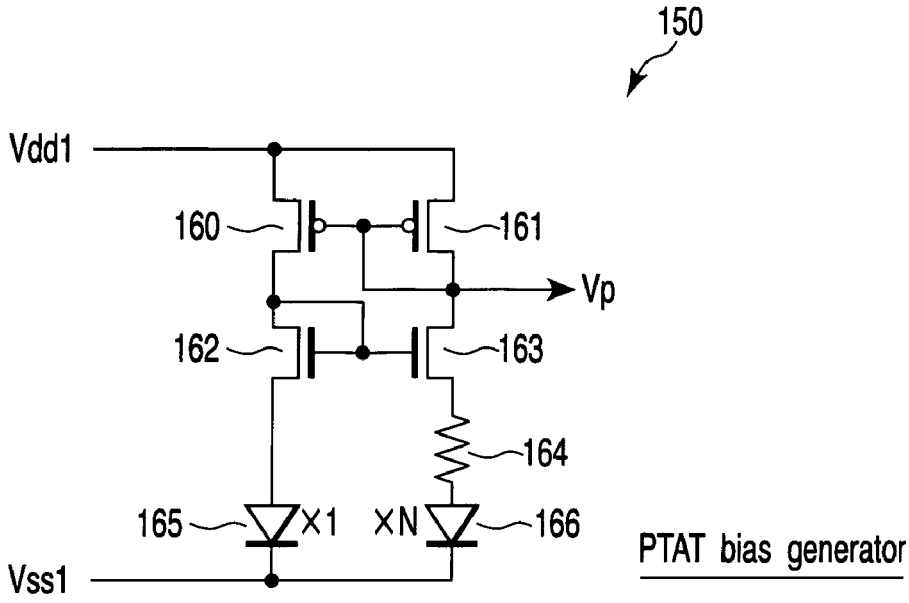
FIG. 31 is a circuit diagram of a PTAT bias generator provided in a radio communication semiconductor integrated circuit according to a sixth embodiment of the present invention.
Figure 32:
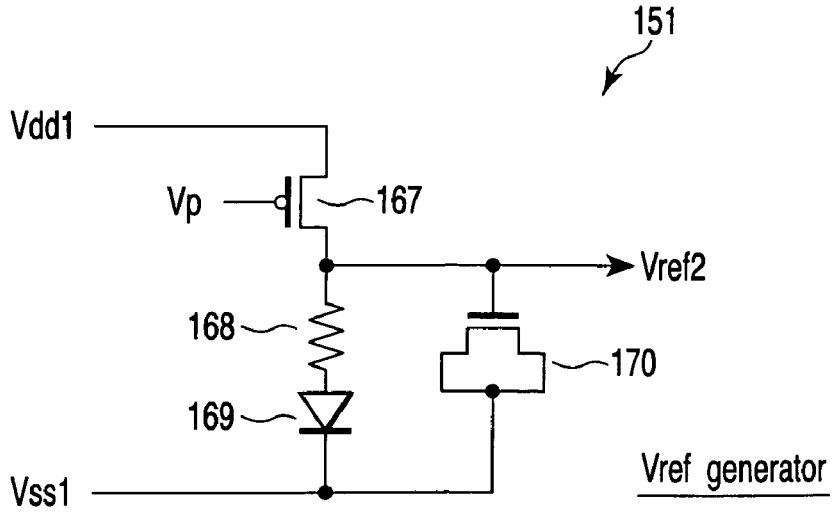
FIG. 32 is a circuit diagram of a reference voltage generator provided in the radio communication semiconductor integrated circuit according to the sixth embodiment of the present invention.

As shown in FIGS. 31 and 32, in the PTAT bias generator 150 and reference voltage generator 151 configured as shown in FIG. 23 and 24 and described in the fifth embodiment, the power supply potential node may be connected to a Vdd1 node. The ground potential node may be connected to a Vss1 node.

Figure 33:
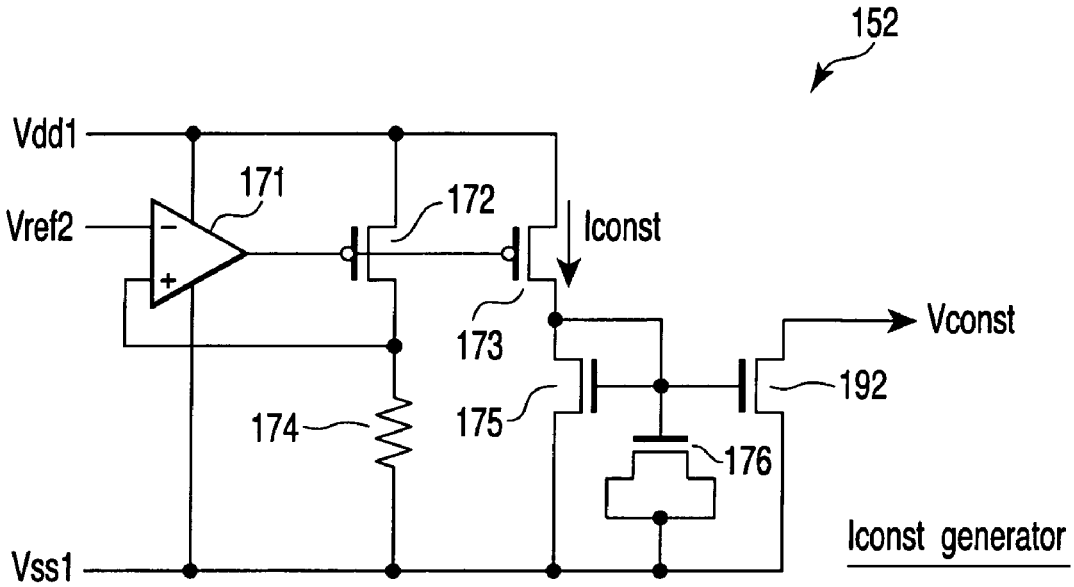
FIG. 33 is a circuit diagram of an Iconst generator provided in the radio communication semiconductor integrated circuit according to the sixth embodiment of the present invention.

As shown in FIG. 33, in the Iconst generator 152 configured as shown in FIG. 25, the power supply potential node is connected to the Vdd1 node. The ground potential node is connected to the Vss1 node. The voltage Vconst is extracted via an n-channel MOS transistor 192. A gate of the n-channel MOS transistor 192 is connected to the gates of the n-channel MOS transistors 175 and 176. A source of the n-channel MOS transistor 192 is connected to the Vss1 node. The voltage Vconst is output by the n-channel MOS transistor 192 through its drain.

Figure 34:
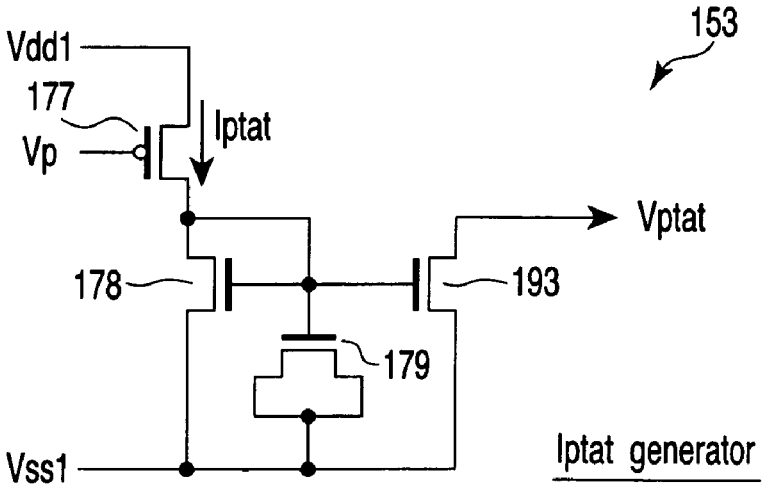
FIG. 34 is a circuit diagram of an Iptat generator provided in the radio communication semiconductor integrated circuit according to the sixth embodiment of the present invention.

As shown in FIG. 34, in the Iptat generator 153 configured as shown in FIG. 26, the power supply potential node is connected to the Vdd1 node. The ground potential node is connected to the Vss1 node. The voltage Vptat is extracted via an n-channel MOS transistor 193. A gate of the n-channel MOS transistor 193 is connected to the gates of the n-channel MOS transistors 178 and 179. A source of the n-channel MOS transistor 193 is connected to the Vss1 node. The voltage Vptat is output by the n-channel MOS transistor 193 through its drain.

FIGS. 35 to 39 are circuit diagrams of the voltage/current generator 155. FIGS. 35 to 39 show configurations in which the current Ibias has a temperature coefficient TC of 46%/70° C., 12%/70° C., −23%/70° C., 23%/70° C., or 0%/70° C.

Figure 35:
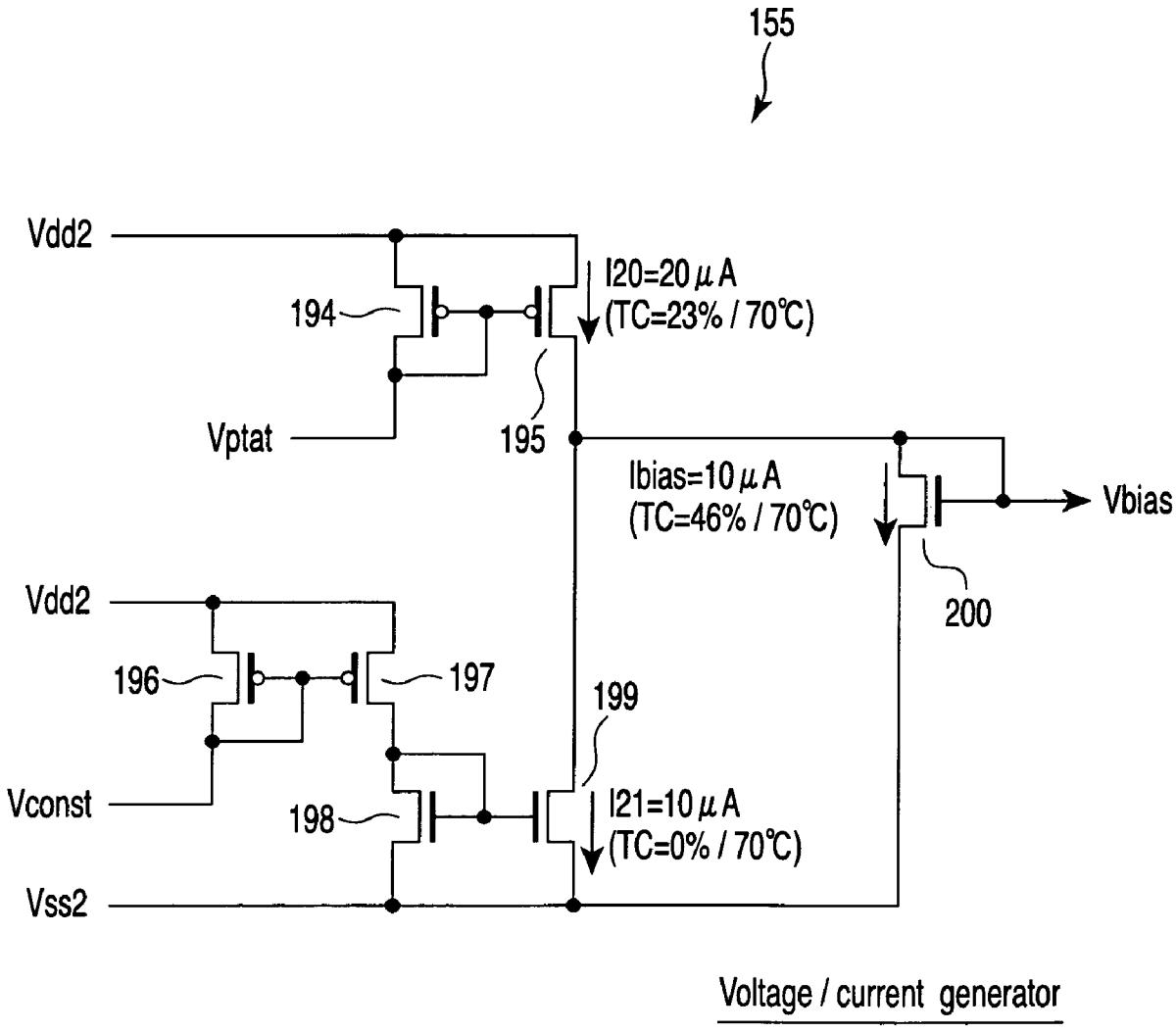
FIG. 35 is a circuit diagram of a voltage/current generator provided in the radio communication semiconductor integrated circuit according to the sixth embodiment of the present invention.

First, the configuration shown in FIG. 35 will be described. As shown in the figure, the voltage/current generator 155 comprises p-channel MOS transistors 194 to 197 and n-channel MOS transistors 198 to 200. Sources of the p-channel MOS transistors 194 and 195 are connected to a Vdd2 node. Gates of the p-channel MOS transistors 194 and 195 are connected together to form a current mirror circuit. The voltage Vptat output by the Iptat generator 153, shown in FIG. 35, is applied to a drain of the p-channel MOS transistor 194. Sources of the p-channel MOS transistors 196 and 197 are connected to the Vdd2 node. Gates of the p-channel MOS 196 and 197 transistors are connected together to form a current mirror circuit. The voltage Vconst output by the Iconst generator 152, shown in FIG. 34, is applied to a drain of the p-channel MOS transistor 196. Gates of the n-channel MOS transistors 198 and 199 are connected together to form a current mirror circuit. A drain of the n-channel MOS transistor 198 and gates of the n-channel MOS transistors 198 and 199 are connected to a drain of the p-channel MOS transistor 197. Further, sources of the n-channel MOS transistors 198 and 199 are connected to the Vss2 node. A drain of the n-channel MOS transistor 199 is connected to a drain of the p-channel MOS transistor 195. A source of the n-channel MOS transistor is connected to the Vss2 node. A gate and a drain of the n-channel MOS transistor 200 are connected to the drain of the p-channel MOS transistor 195. The voltage Vbias is output by the n-channel MOS transistor 200 through its gate and drain.

The n-channel MOS transistor 195 supplies a current I20 in response to the voltage Vptat. The current I20 has a temperature coefficient TC=23%/70° C. Further, The n-channel MOS transistor 199 supplies a current I21 in response to the voltage Vconst. The current I21 has a temperature coefficient TC=0%/70° C. Accordingly, the current Ibias supplied by the n-channel MOS transistor 200 has a temperature coefficient TC of 46%/70° C.

Figure 36:
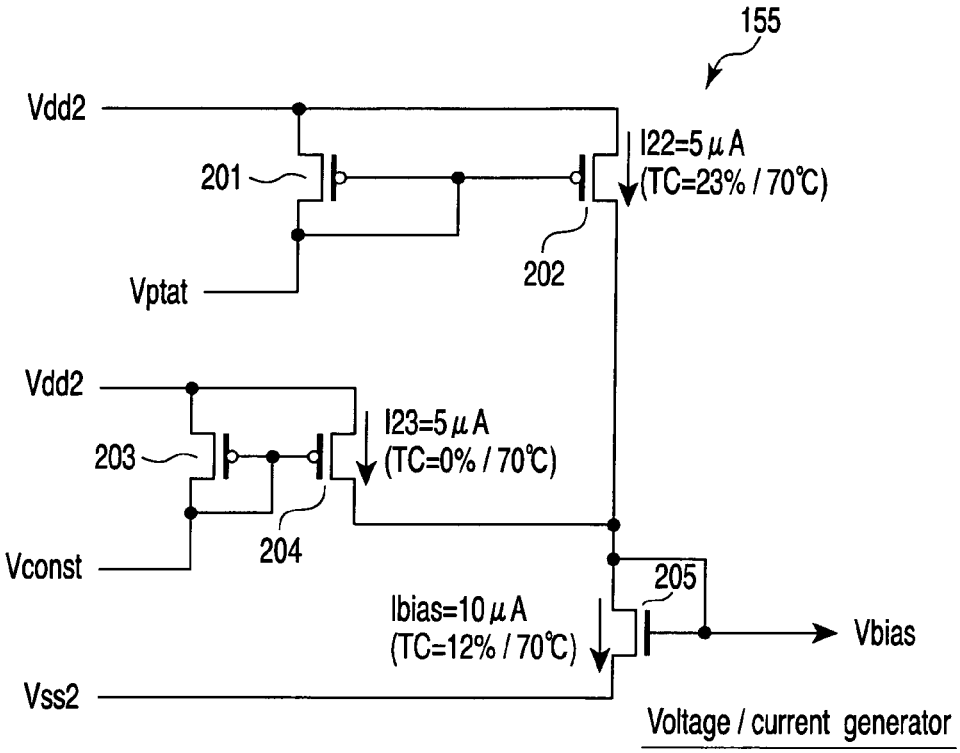
FIG. 36 is a circuit diagram of a voltage/current generator provided in the radio communication semiconductor integrated circuit according to the sixth embodiment of the present invention.

Now, description will be given of the voltage/current generator 155 shown in FIG. 36. As shown in the figure, the voltage/current generator 155 comprises p-channel MOS transistors 201 to 204 and an n-channel MOS transistor 205. Sources of the p-channel MOS transistors 201 and 202 are connected to the Vdd2 node. Gates of the p-channel MOS transistors 201 and 202 are connected together to form a current mirror circuit. The voltage Vptat is applied to a gate and a drain of the p-channel MOS transistor 201. Sources of the p-channel MOS transistors 203 and 204 are connected to the Vdd2 node. Gates of the p-channel MOS transistors 203 and 204 are connected together to form a current mirror circuit. The voltage Vconst is applied to a drain of the p-channel MOS transistor 203. A source of the n-channel MOS transistor is connected to the Vss2 node. A gate and a drain of the n-channel MOS transistor are connected to drains of the p-channel MOS transistors 202 and 204. The voltage Vbias is output by the n-channel MOS transistor 205 through its gate and drain.

In this configuration, the p-channel MOS transistor 202 supplies a current I22 corresponding to the voltage Vptat. The current I22 has a temperature coefficient TC=23%/70° C. Further, The p-channel MOS transistor 204 supplies a current I23 corresponding to the voltage Vconst. The current I23 has a temperature coefficient TC=0%/70° C. As a result, the current Ibias supplied by the n-channel MOS transistor 205 has a temperature coefficient TC of 12%/70° C.

Figure 37:
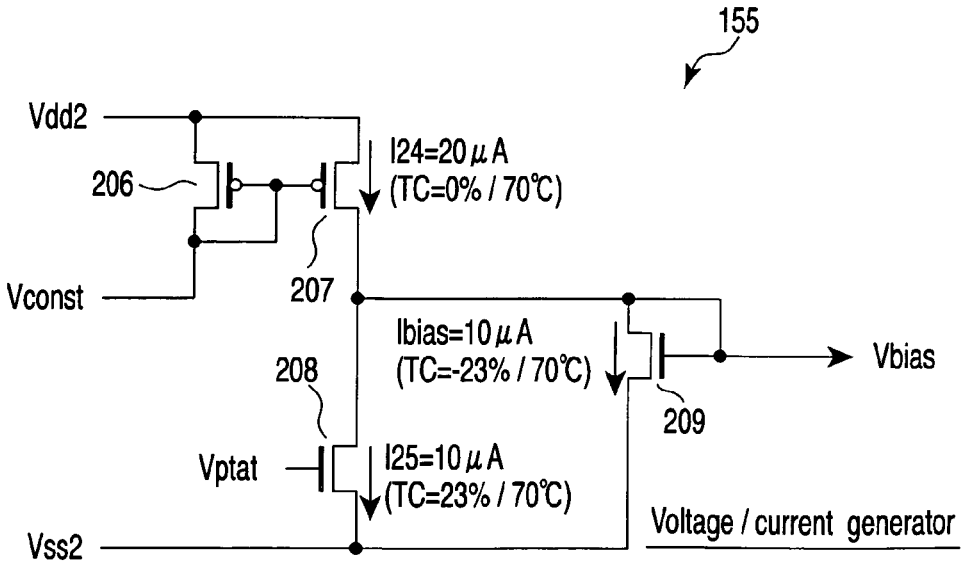
FIG. 37 is a circuit diagram of a voltage/current generator provided in the radio communication semiconductor integrated circuit according to the sixth embodiment of the present invention.

Now, description will be given of the voltage/current generator 155 shown in FIG. 37. As shown in the figure, the voltage/current generator 155 comprises p-channel MOS transistors 206 and 207 and n-channel MOS transistors 208 and 209. Sources of the p-channel MOS transistors 206 and 207 are connected to the Vdd2 node. Gates of the p-channel MOS transistors 206 and 207 are connected together to form a current mirror circuit. The voltage Vconst is applied to a gate and a drain of the p-channel MOS transistor 206. A source of the n-channel MOS transistor 208 is connected to the Vdd2 node. The voltage Vptat is applied to a gate of the n-channel MOS transistor 208. A drain of the n-channel MOS transistor 208 is connected to a drain of the p-channel MOS transistor 207. A source of the n-channel MOS transistor 209 is connected to the Vss2 node. A gate and a drain of the n-channel MOS transistor 209 are connected to the drain of the p-channel MOS transistor 207. The voltage Vbias is output by the n-channel MOS transistor 209 through its gate and drain.

In this configuration, the p-channel MOS transistor 207 supplies a current I24 corresponding to the voltage Vconst. The current I24 has a temperature coefficient TC=0%/70° C. Further, The p-channel MOS transistor 208 supplies a current I25 corresponding to the voltage Vptat. The current I25 has a temperature coefficient TC=23%/70° C. Consequently, the current Ibias supplied by the n-channel MOS transistor 209 has a temperature coefficient TC of −23%/70° C.

Now, description will be given of the voltage/current generator 155 shown in FIG. 38. As shown in the figure, the voltage/current generator 155 comprises p-channel MOS transistors 210 and 211 and an n-channel MOS transistor 212. Sources of the p-channel MOS transistors 210 and 211 are connected to the Vdd2 node. Gates of the p-channel MOS transistors 210 and 211 are connected together to form a current mirror circuit. The voltage Vptat is applied to a drain and a gate of the p-channel MOS transistor 210. A source of the n-channel MOS transistor 212 is connected to the Vdd2 node. A gate and a drain of the n-channel MOS transistor 212 are connected to a drain of the p-channel MOS transistor 211. The voltage Vbias is output by the n-channel MOS transistor 212 through its gate and drain.

In this configuration, the p-channel MOS transistor 211 supplies a current I26 corresponding to the voltage Vptat. The current I26 has a temperature coefficient TC=23%/70° C. Consequently, the current Ibias supplied by the n-channel MOS transistor 212 also has a temperature coefficient TC of 23%/70° C.

Figure 38:
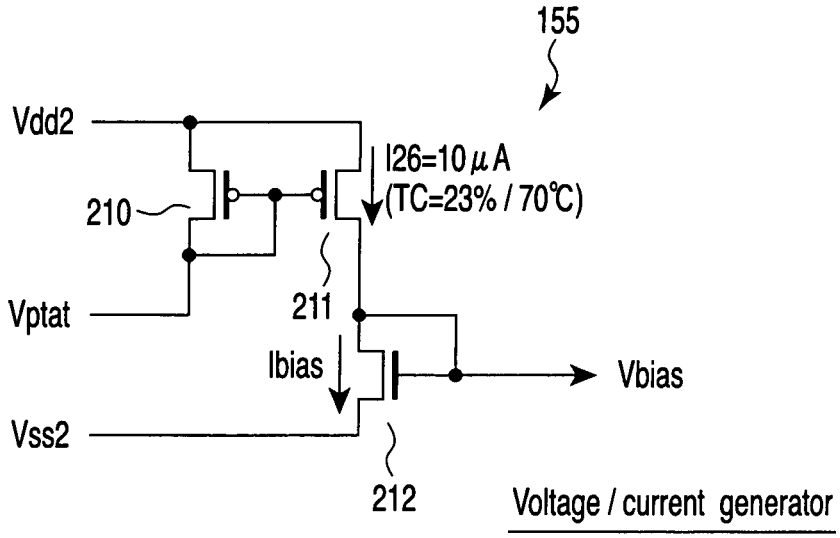
FIG. 38 is a circuit diagram of a voltage/current generator provided in the radio communication semiconductor integrated circuit according to the sixth embodiment of the present invention.

In FIG. 38, if the voltage Vconst is applied to the gate and drain of the p-channel MOS transistor 210, the current Ibias supplied by the n-channel MOS transistor 212 has a temperature coefficient of 0%/70° C.

The present embodiment can produce the effects described in the fifth embodiment even if the power supply voltage for the PTAT (Proportional To Absolute Temperature) bias generator 150, reference voltage generator 151, Iconst generator 152, and Iptat generator 153 is different from that for the voltage/current generator 155.

Now, description will be given of a radio communication semiconductor integrated circuit comprising an intensity detecting circuit using the voltage subtracting circuit according to the seventh embodiment of the present invention. The present embodiment corresponds to the fifth and sixth embodiments which use a voltage Vf to generate a bias current and voltages Ibias and Vbias.

Figure 39:
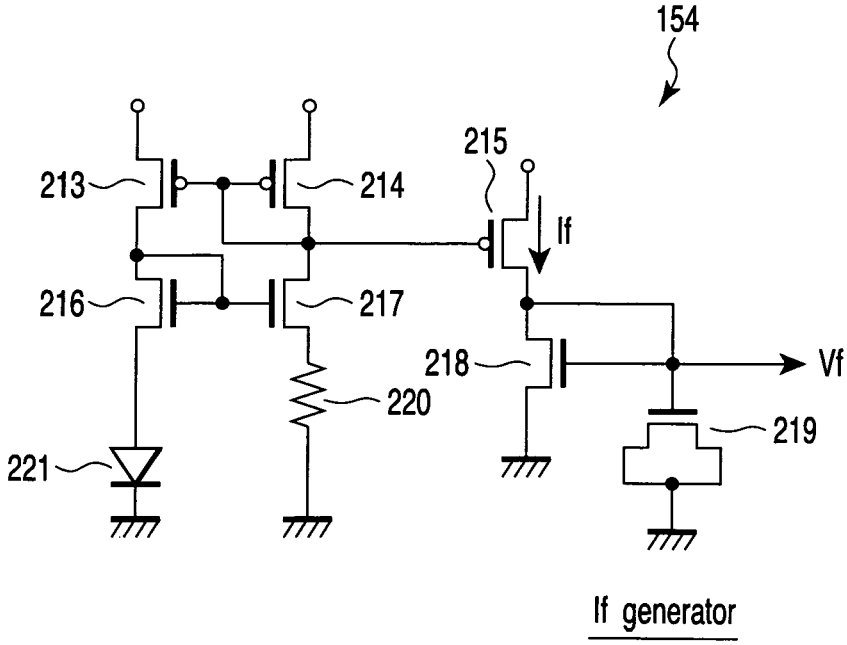
FIG. 39 is a circuit diagram of an If generator provided in a radio communication semiconductor integrated circuit according to a seventh embodiment of the present invention.

FIG. 39 is a circuit diagram of the If generator 154 described in the fifth embodiment. As shown in the figure, the If generator 154 comprises p-channel MOS transistors 213 to 215, n-channel MOS transistors 216 to 219, a resistance element 220, and a diode 221. Sources of the p-channel MOS transistors 213 and 214 are connected to the power supply potential. Gates of the p-channel MOS transistors 213 and 214 are connected together to form a current mirror circuit. A gate of the p-channel MOS transistor 214 is connected to a drain of the p-channel MOS transistor 214. Drains of the n-channel MOS transistors 216 and 217 are connected to drains of the p-channel MOS transistors 213 and 214. Gates of the n-channel MOS transistors 216 and 217 are connected together to form a current mirror circuit. A gate of the n-channel MOS transistor 216 is connected to the drain of the n-channel MOS transistor 216. The diode 221 is connected between the n-channel MOS transistor 216 and the ground potential. The resistance element 220 is connected between the n-channel MOS transistor 217 and the ground potential. A source of the p-channel MOS transistor 215 is connected to the power supply potential. A gate of the p-channel MOS transistor 215 is connected to the gates of the p-channel MOS transistors 213 and 214. A source of the n-channel MOS transistor 218 is connected to the ground potential. A gate and a drain of the n-channel MOS transistor 218 are connected to a drain of the p-channel MOS transistor 215. A gate of the n-channel MOS transistor 219 is connected to a gate and a drain of the n-channel MOS transistor 218. A source and a drain of the n-channel MOS transistor 219 are connected together and to the ground potential. The p-channel MOS transistor 215 supplies a current If inversely proportional to a variation in temperature. The voltage Vf is thus extracted from the drain of the p-channel MOS transistor 215.

If instead of the voltage Vptat, the voltage Vf is applied to the voltage/current generator 155 shown in FIGS. 27 to 29, the voltage/current generator 155 supplies a current Ibias having a temperature coefficient of 33%/70° C., 0%/70° C., or −33%/70° C.

According to the present embodiment, by using a current inversely proportional to a variation in temperature, it is possible to set the dependence of the current Ibias on the temperature in further detail than in the fifth and sixth embodiments.

The fifth to seventh embodiments allow the operating currents for the amplification circuit 113 (low noise amplifier 103 and mixer 104) and intensity detecting circuit 105, for instance, to have the desired temperature coefficients. It is thus possible to control a gain characteristic of the amplification circuit 113 and the associated gain adjustment characteristic of the intensity detecting circuit. This serves to improve the operational performance of the radio communication semiconductor integrated circuit.

Now, description will be given of a radio communication semiconductor integrated circuit according to an eighth embodiment of the present invention. The present embodiment relates to the arrangement of circuit blocks in the radio communication semiconductor integrated circuits described in the fourth to seventh embodiments.

Figure 40:
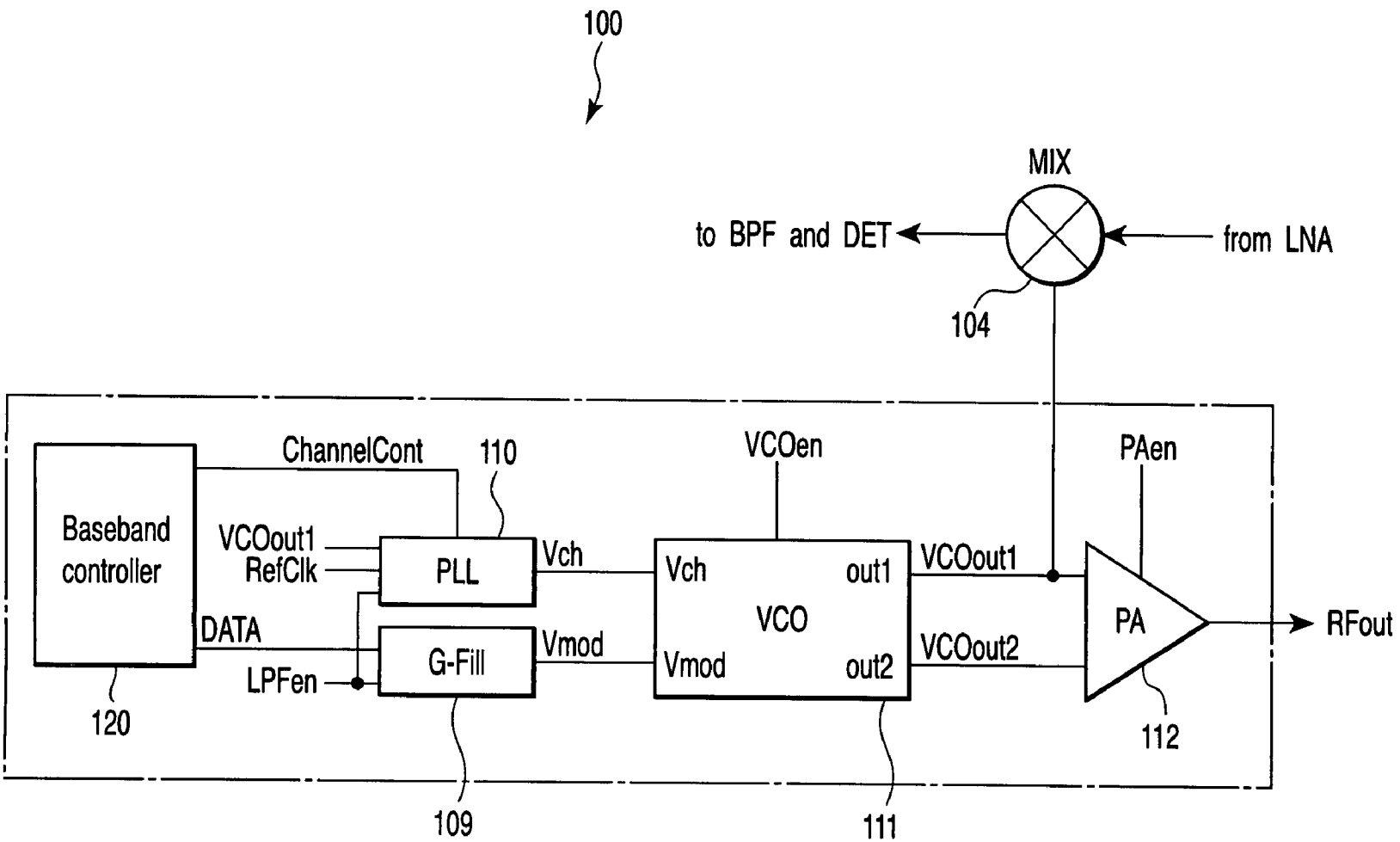
FIG. 40 is a block diagram of a radio communication semiconductor integrated circuit according to an eighth embodiment of the present invention, particularly showing a transmission section of an RF block.

FIG. 40 is a block diagram focusing particularly on a transmission unit of the Bluetooth module described in the fourth embodiment. As shown in the figure, the transmission unit comprises a baseband controller 120, a Gaussian low pass filter 109, a PLL circuit 110, a voltage control oscillating circuit 111, and a power amplifier 112.

Figure 41:
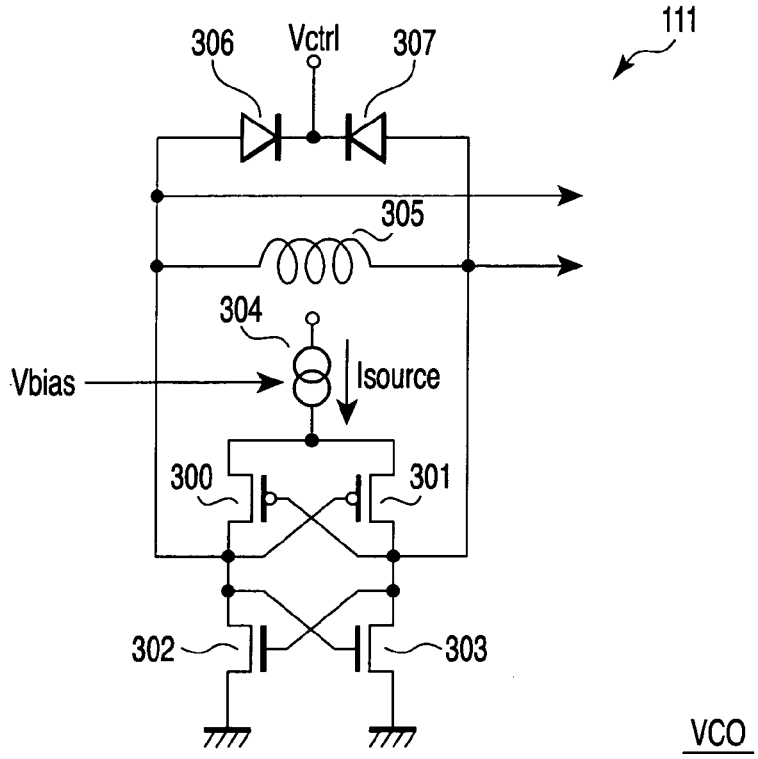
FIG. 41 is a circuit diagram of a voltage control oscillating circuit provided in the radio communication semiconductor integrated circuit according to the eighth embodiment of the present invention.

FIG. 41 is a circuit diagram of the voltage control oscillating circuit 111. As shown in the figure, the voltage control oscillating circuit 111 comprises p-channel MOS transistors 300 and 301, n-channel MOS transistors 302 and 303, a current source 304, an inductor 305, and varactor diodes 306 and 307.

Sources of the p-channel MOS transistors 300 and 301 are connected to the current source 304. Drains of the p-channel MOS transistors 300 and 301 are connected to drains of the n-channel MOS transistors 302 and 303, respectively. Sources of the n-channel MOS transistors 302 and 303 are connected to the ground potential. A gate of the p-channel MOS transistor 301 is connected to a drain of the p-channel MOS transistor 300. A gate of the p-channel MOS transistor 300 is connected to a drain of the p-channel MOS transistor 301. A gate of the n-channel MOS transistor 302 is connected to a drain of the n-channel MOS transistor 303. A gate of the n-channel MOS transistor 303 is connected to a drain of the n-channel MOS transistor 302.

An inductor 305 is connected between the drain of the p-channel MOS transistor 300 and the drain of the p-channel MOS transistor 301. Further, an anode of the varactor diode 306 is connected to the drain of the p-channel MOS transistor 300. A control Vctrl is applied to a cathode of the varactor diode 306. An anode of the varactor diode 307 is connected to the drain of the p-channel MOS transistor 301. The control Vctrl is applied to a cathode of the varactor diode 307. The control voltage Vctrl is generated using, for example, voltages Vch, Vmod, and VCOen.

In the above configuration, an oscillation signal having an oscillation frequency determined by the varactor diodes 306 and 307 is amplified by an amplification circuit formed of the p-channel MOS transistors 300 and 301 and n-channel MOS transistors 302 and 303. The current source 304 is controlled by the voltage Vbias to supply a current Isource corresponding to the voltage Vbias.

Figure 42:
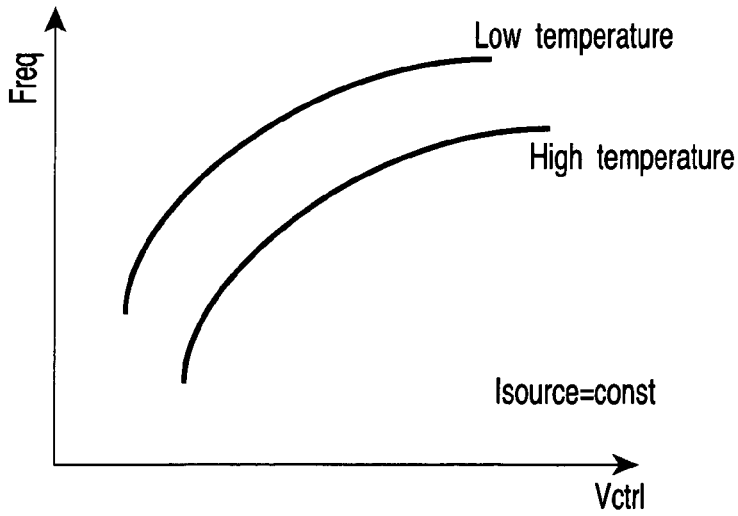
FIG. 42 is a graph showing a temperature characteristic of an oscillation frequency of the voltage control oscillating circuit.

FIG. 42 is a graph showing a control voltage-oscillation frequency characteristic of the voltage control oscillating circuit 111. As shown in the figure, when the current Isource is fixed regardless of the temperature, the oscillation frequency varies significantly depending on the temperature. This is because the varactor diodes 306 and 307 and MOS transistors 300 to 303, forming the voltage control oscillating circuit 111, have high temperature dependences.

Figure 43:
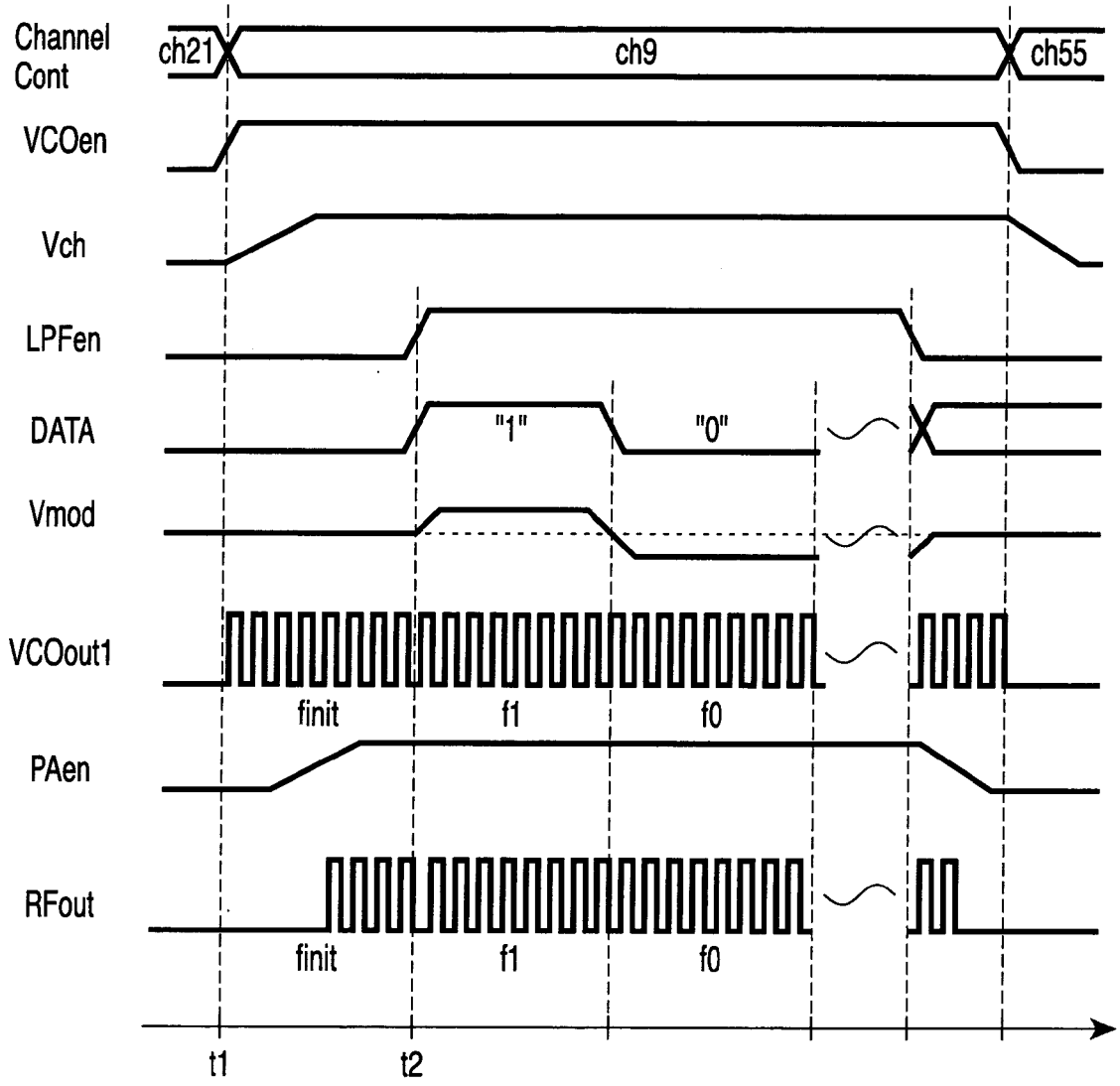
FIG. 43 timing chart of various signals in the radio communication semiconductor integrated circuit according to the eighth embodiment of the present invention.

Now, with reference to FIG. 43, description will be given of operations of the Bluetooth module shown in FIG. 40. FIG. 43 is a timing chart of each signal.

First, for a data transmission, the baseband controller 120 selects and supplies an arbitrary frequency channel ChannelCont to the PLL circuit 110 (time t1). Further, a VCO enable signal VCOen is input to the voltage control oscillating circuit 111 to activate it (time t1). The oscillation frequency of the voltage control oscillating circuit 111 obtained at this time is defined as finit. A reference clock RefClk and an output VCOout1 from the voltage control oscillating circuit 111 are input to the PLL circuit 110. The PLL circuit 110 divides the reference clock RefClk into a number of frequencies depending on the frequency channel ChannelCont provided by the baseband controller 120. The PLL circuit 110 controls the control voltage Vch so that the phases of a frequency dividing clock and VCOout1 match. The control voltage Vch is input to the voltage control oscillating circuit 111. In the meantime, the reference voltage is input to the other input terminal Vmod of the voltage control oscillating circuit 111.

Once the voltage control oscillating circuit 111 starts to operate stably, a Gaussian low pass filter activation signal LPFen is asserted (time t2). Thus, data DATA is input to the voltage control oscillating circuit 111. A feedback loop in the PLL circuit 110 is discontinued (this is called an open loop). This allows the PLL circuit 110 to hold the specified potential Vch. Then, the potential of the signal Vmod is controlled on the basis of the data DATA ("1"/"0"). As a result, the oscillation frequency of the voltage control oscillating circuit 111 is modulated. The power amplifier 112 amplifies an output from the voltage control oscillating circuit 111 to output a transmitted signal RFout.

Figure 44:
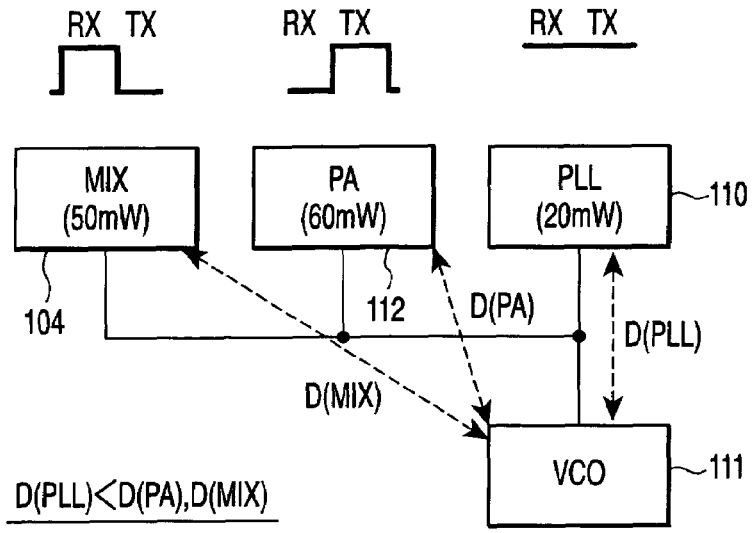
FIG. 44 is a block diagram of a partial area of the radio communication semiconductor integrated circuit according to the eighth embodiment of the present invention, showing the arrangement of the voltage control oscillating circuit, a mixer, a power amplifier, and a PLL circuit.

FIG. 44 is a block diagram showing the arrangement of the voltage control oscillating circuit 111 and three circuit blocks (mixer 104, power amplifier 112, and PLL circuit 110) connected to the voltage control oscillating circuit 111, in the Bluetooth module according to the present embodiment. As shown in the figure, the distances between the voltage control oscillating circuit 111 and each of the mixer 104, power amplifier 112, and PLL circuit 110 are defined as D(MIX), D(PA), and D(PLL), respectively. Then, the relationship D(PLL)<D(PA) and D(MIX) is established.

As described above, the radio communication semiconductor integrated circuit according to the present embodiment can improve communication accuracy and reliability. This will be described below in detail.

In the radio communication semiconductor integrated circuit, data is alternately transmitted and received. Accordingly, heat associated with power consumption temporally varies the peripheral temperature of the voltage control oscillating circuit 111. A variation in temperature following opening of the loop in the PLL circuit 110 varies the oscillation frequency of the voltage control oscillating circuit 111. A large variation in oscillation frequency makes it difficult for a system receiving this signal to make correct data determinations. As a result, the bit error rate increases to degrade the reliability of communications.

However, the configuration according to the present embodiment controls the current source for the voltage control oscillating circuit 111 using a voltage Vbias generated by the bias current/voltage generator 114. Consequently, adjustment of the voltage Vbias enables the suppression of a variation in the oscillation frequency of the voltage control oscillating circuit 111 which variation is dependent on the temperature. That is, the voltage Vbias is used to compensate for a variation in oscillation frequency caused by a variation in temperature. Consequently, the oscillation frequency of the voltage control oscillating circuit 111 is always fixed, thus improving the communication accuracy.

Further, the mixer 104, the power amplifier 112, and the PLL circuit 110 are connected to the voltage control oscillating circuit 111. The mixer 104 generates heat during a reception period RX. The power amplifier 112 generates heat during a transmission period TX. The PLL circuit 110 generates heat during both transmission and reception. In this manner, a block that repeats an operative state and an inoperative state repeats a heat generation period and a non-heat-generation period. When the voltage control oscillating circuit 111 is located near such a block, the oscillation frequency of the voltage control oscillating circuit 111 is varied by a variation in temperature associated with a variation in heat from the block.

However, in the configuration according to the present embodiment, the distance D (MIX) between the voltage control oscillating circuit 111 and mixer 104 and the distance D (PA) between the voltage control oscillating circuit 111 and the power amplifier 112, which repeat a heat generation period and a non-heat-generation period are longer than that D (PLL) between the voltage control oscillating circuit 111 and the PLL circuit 110, which always generates heat. Accordingly, the voltage control oscillating circuit 111 is unlikely to be affected by a variation in the temperature of the mixer 104 and power amplifier 112. This enables the oscillation frequency to be kept constant. By the way, if the mixer 104 and the power amplifier 112 have almost the same power consumption, D(MIX) and D(PA) are desirably equivalent. This is because the mixer 104 stops operations before transmission is started, whereas the power amplifier 112 starts operations when the transmission is started. In this case, when D(MIX)=D(PA), a variation in heat in the voltage control oscillating circuit 111 is averaged and reduced. If the power amplifier 111 has a more power consumption than the mixer 104, then desirably D(MIX)<D (PA). If the power consumptions of the power amplifier 112 and mixer 104 are defined as P(PA) and P(MIX), respectively, $\alpha$=D(PA)/D(MIX) is desirably proportional to $\beta$=P (PA)/P(MIX). If heat from each block diffuse isotropically, $\alpha$ is desirably proportional to $\beta^2$.

Figure 45:
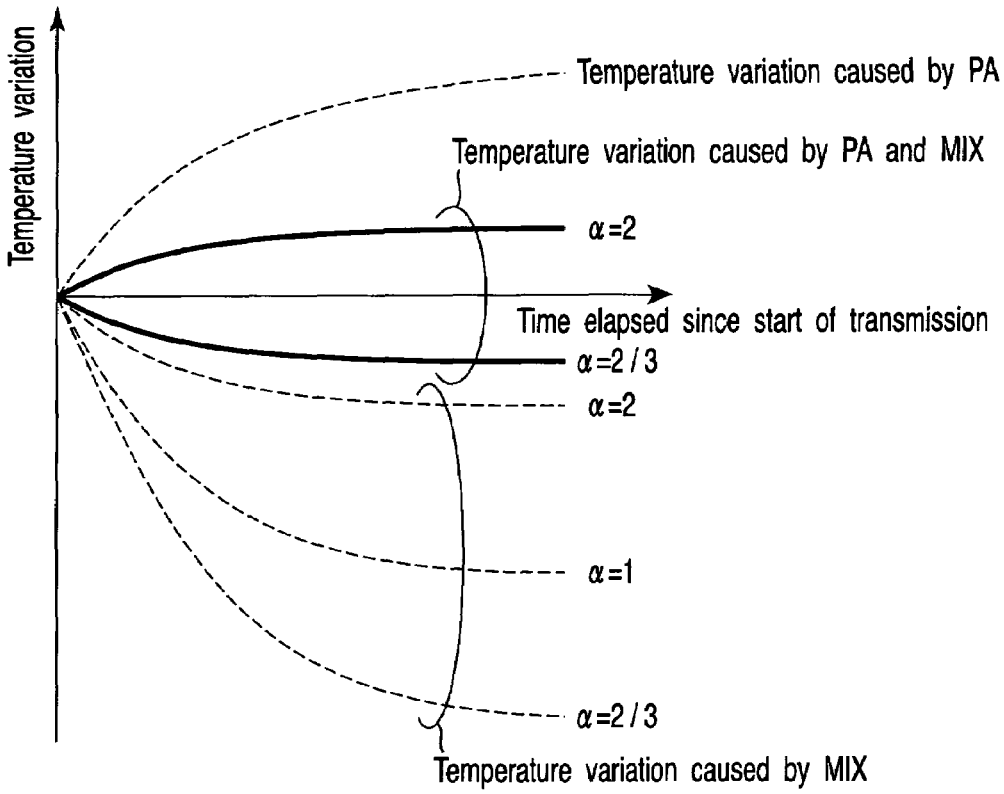
FIG. 45 is a graph showing the relationship between the time elapsed since the start of transmission and the amount of variation in temperature in the radio communication semiconductor integrated circuit according to the eighth embodiment of the present invention.

FIG. 45 is a graph showing the relationship between the time elapsed from the start of transmission and a variation in temperature for $\alpha=\frac{1}{2}\beta$ and for $\alpha=2\beta$. The figure indicates that a variation in temperature is totally suppressed when D(PLL)<D(MIX) and D(PA).

As described above, the oscillation frequency of the voltage control oscillating circuit 111 can be kept constant by being controlled using the voltage Vbias and improving the arrangement of the circuit blocks connected to the voltage control oscillating circuit 111.

Figure 46:
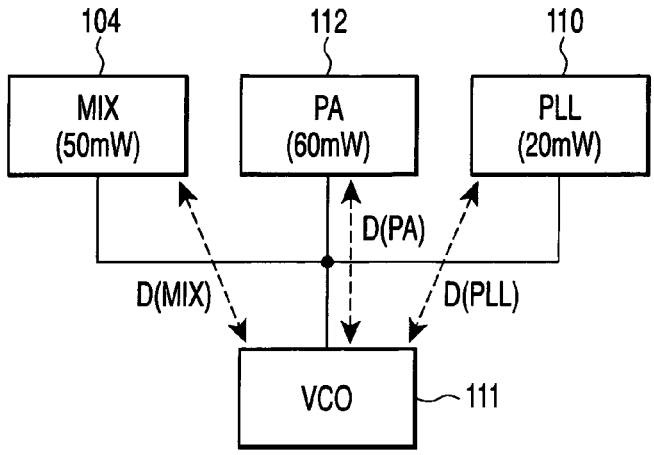
FIG. 46 is a block diagram of the partial area of the radio communication semiconductor integrated circuit according to the eighth embodiment of the present invention, showing the arrangement of the voltage control oscillating circuit, the mixer, the power amplifier, and the PLL circuit.
Figure 47:
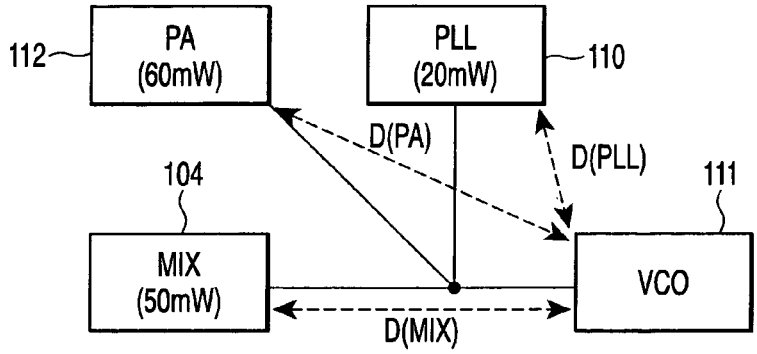
FIG. 47 is a block diagram of the partial area of the radio communication semiconductor integrated circuit according to the eighth embodiment of the present invention, showing the arrangement of the voltage control oscillating circuit, the mixer, the power amplifier, and the PLL circuit.
Figure 48:
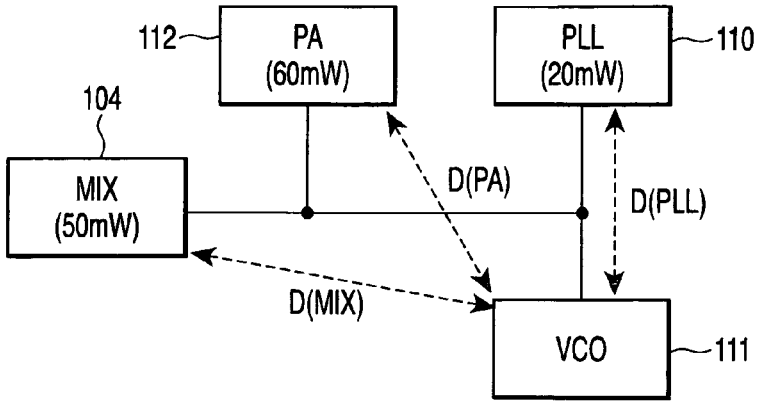
FIG. 48 is a block diagram of the partial area of the radio communication semiconductor integrated circuit according to the eighth embodiment of the present invention, showing the arrangement of the voltage control oscillating circuit, the mixer, the power amplifier, and the PLL circuit.

The positional relationship among the voltage control oscillating circuit 111, the mixer 104, the power amplifier 112, and the PLL circuit 110 is not limited to that shown in FIG. 44. For example, arrangements such as those shown in FIGS. 46 to 48 may be used. The arrangement is not particularly limited provided that the condition D(PLL)<D (PA) and D(MIX) is met.

As described above, the voltage subtracting circuit according to the embodiments of the present first converts input voltages into currents using the voltage/current converting circuit. Then, a subtraction is carried out on the currents, which are then converted into voltages. Therefore, the result of the voltage subtraction is unlikely to be affected by a variation in process or temperature. Accurate voltage subtractions can be accomplished.

The amplitude voltage of a received signal can be accurately extracted by applying the voltage subtracting circuit according to the present embodiment to the intensity detecting circuit in the radio communication semiconductor integrated circuit. As a result, the amplification factor for the received signal can be accurately controlled. Moreover, in the radio communication semiconductor integrated circuit, the distance between the voltage control oscillating circuit and circuit blocks connected to the voltage control oscillating circuit and repeating the operative state and the inoperative state is set longer than the distance between the voltage control oscillating circuit and circuit blocks connected to the voltage control oscillating circuit and which are always in operation. Thus, the voltage control oscillating circuit is unlikely to be affected by a variation in the temperatures of surrounding circuit blocks. Therefore, the oscillation frequency can be kept constant.

In the description of the above embodiments, in the voltage subtracting circuit 1 shown in FIGS. 1 and 10, the resistance elements have the same resistance value. Further, the p-channel MOS transistors 14 and 15 have the same size. However, a voltage proportional to the differential voltage can be extracted by varying the resistance values of the resistance elements 16 and 32 and the sizes of the p-channel MOS transistors 14 and 15. Further, in the description of the second embodiment, the reference voltage is provided as the voltage V1, and the signal voltage that oscillates around the reference voltage is provided as the voltage V2. However, it is not important that one of the voltages V1 and V2 be the reference or signal voltage. The input voltages are not limited unless the differential voltage has a negative value.

The above embodiments have been described in conjunction with the Bluetooth module. However, of course, the present embodiments are applicable to wireless LAN or IrDA modules.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A voltage subtracting circuit comprising:

a conversion circuit which converts a first voltage input during a first period into a first current proportional to the first voltage and which converts a second voltage input during a second period following the first period into a second current proportional to the second voltage, said conversion circuit including, a first switch element which, during the first period, inputs the first voltage into the conversion circuit without inputting the second voltage into the conversion circuit and which, during the second period, inputs the second voltage into the conversion circuit without inputting the first voltage into the conversion circuit;

a holding circuit which holds the first current during the first period as a third voltage and which outputs the first current during the second period on the basis of the third voltage; and a differential voltage generator which outputs a differential voltage between the second voltage and the first voltage during the second period on the basis of the second current output by the conversion circuit and the first current output by the holding circuit.

2. The circuit according to claim 1, wherein the conversion circuit comprises an operational amplifier comprising an inverted input terminal to which the first and second voltages are input and a non-inverted input terminal connected to a resistance element, a first transistor comprising a gate to which an output terminal of the operational amplifier is connected and a drain to which the resistance element is connected, and a second transistor comprising a gate to which the output terminal of the operational amplifier is connected and a drain connected to an output terminal of the conversion circuit, the first current and the second current being output from the output terminal of the conversion circuit.

3. The circuit according to claim 1, wherein the holding circuit comprises a first transistor having a drain connected to an output terminal of the conversion circuit from which the first or second current is output, a capacitance element having one electrode connected to a gate of the first transistor, and a second switch element which switches a connection between the output terminal of the conversion circuit and both the gate of the first transistor and the one electrode of the capacitance element.

4. The circuit according to claim 3, wherein during the first period, the second switch element connects both the gate of the first transistor and the one electrode of the capacitance element to the output terminal of the conversion circuit, the first transistor outputs the first current as a drain current and the capacitance element holds a gate voltage of the first transistor as the third voltage, during the second period, the second switch element disconnects both the gate of the first transistor and the one electrode of the capacitance element from the output terminal of the conversion circuit, and the first transistor outputs the first current as the drain current on the basis of the third voltage held in the capacitance element.

5. The circuit according to claim 1, wherein the holding circuit comprises a first transistor of a first conductive type which has a gate and a drain connected to an output terminal of the conversion circuit from which the first or second current is output, a second transistor of the first conductive type which has a gate connected to the gate of the first transistor and which forms a current mirror circuit together with the first transistor, a third transistor of a second conductive type which has a drain connected to a drain of the second transistor, a capacitance element having one electrode connected to a gate of the third transistor, and a switch element which switches a connection between drains of the second and third transistors and both the gate of the third transistor and the one electrode of the capacitance element.

6. The circuit according to claim 5, wherein the during the first period, the switch element connects both the gate of the third transistor and the one electrode of the capacitance element to the drains of the second and third transistors, the third transistor outputs the first current as a drain current and the capacitance element holds the gate voltage of the third transistor as the third voltage, during the second period, the switch element disconnects both the gate of the third transistor and the one electrode of the capacitance element from the drains of the second and third transistors, and the third transistor outputs the first current as the drain current on the basis of the third voltage held in the capacitance element.

7. The circuit according to claim 1, wherein the differential voltage generator comprises a resistance element, and a second switch element which switches a connection between an output node of the holding circuit and one end of the resistance element, wherein the second switch element connects the resistance element and the output node of the holding circuit together during the second period to supply the resistance element with the second current output by the conversion circuit and the first current output by the holding circuit.

8. An intensity detecting circuit comprising:

a voltage subtracting circuit which executes a subtraction on a first voltage and a second voltage;

a reference voltage generator which generates a temporally fixed reference voltage and which supplies the reference voltage to the voltage subtracting circuit during a first period as the first voltage; and a voltage converting circuit which generates the second voltage from a temporally varying signal voltage and which supplies the second voltage to the voltage subtracting circuit during a second period following the first period, the voltage subtracting circuit including:

a conversion circuit which converts the first voltage input during the first period into a first current proportional to the first voltage and which converts the second voltage input during the second period following the first period into a second current proportional to the second voltage, said conversion circuit including, a first switch element which, during the first period, inputs the first voltage into the conversion circuit without inputting the second voltage into the conversion circuit and which, during the second period, inputs the second voltage into the conversion circuit without inputting the first voltage into the conversion circuit;

a holding circuit which holds the first current during the first period as a third voltage and which outputs the first current during the second period on the basis of the third voltage; and a differential voltage generator which outputs a differential voltage between the second voltage and the first voltage during the second period on the basis of the second current output by the conversion circuit and the first current output by the holding circuit.

9. The circuit according to claim 8, wherein the voltage converting circuit comprises:

a first transistor having a drain to which the signal voltage is applied and a gate connected to the drain, and a second transistor having a drain to which an inverted signal of the signal voltage is applied, a gate connected to the drain, and a source connected to a source of the first transistor, wherein a source voltage of the first and second transistors is supplied to the voltage subtracting circuit as the second voltage.

10. The circuit according to claim 9, wherein a voltage of a direct current component of the signal voltage is equal to the reference voltage.

11. A semiconductor integrated circuit device comprising:

a first amplification circuit which amplifies a radio carrier signal received when data is received;

an intensity detecting circuit which controls a gain of the first amplification circuit;

a voltage control oscillating circuit which generates an oscillation signal;

a mixer which mixes the oscillation signal and the radio carrier signal amplified by the first amplification circuit together to down-convert a frequency of the radio carrier signal to an intermediate frequency;

a second amplification circuit which is operative when dat a is transmitted, to amplify the oscillation signal to be transmitted; and a PLL circuit which controls an oscillation frequency of the oscillation signal, the intensity detecting circuit including:

a voltage subtracting circuit which executes a subtraction on a first voltage and a second voltage and which controls an amplification factor of the first amplification circuit in accordance with a result of the subtraction;

a reference voltage generator which generates a temporally fixed reference voltage and which supplies the reference voltage to the voltage subtracting circuit during a first period as the first voltage; and a voltage converting circuit which generates the second voltage from an output signal from the mixer and an inverted signal of the output signal and which supplies the second voltage to the voltage subtracting circuit during a second period following the first period, the voltage subtracting circuit including:

a conversion circuit which converts the first voltage input during the first period into a first current proportional to the first voltage and which converts the second voltage input during the second period following the first period into a second current proportional to the second voltage, said conversion circuit including, a first switch element which, during the first period, inputs the first voltage into the conversion circuit without inputting the second voltage into the conversion circuit and which, during the second period, inputs the second voltage into the conversion circuit without inputting the first voltage into the conversion circuit;

a holding circuit which holds the first current during the first period as a third voltage and which outputs the first current during the second period on the basis of the third voltage; and a differential voltage generator connected to the conversion circuit and the holding circuit during the second period to output a differential voltage between the second voltage and the first voltage on the basis of the second current output by the conversion circuit and the first current output by the holding circuit.

12. The device according to claim 11, wherein when the second voltage exceeds the first voltage, the intensity detecting circuit controls the first amplifying circuit to reduce the gain compared to a case in which the second voltage does not exceed the first voltage.

13. The device according to claim 11, further comprising a bias current/voltage generator which generates a plurality of bias currents and bias voltages having different temperature dependences, wherein the first amplification circuit, the intensity detecting circuit, the voltage control oscillating circuit, the mixer, the second amplification circuit, and the PLL circuit operate on the basis the bias current and the bias voltage having any of the temperature dependences.

14. The device according to claim 13, wherein the bias current/voltage generator includes a plurality of voltage generators, and a voltage generated by any of the voltage generators varies in inverse proportion to temperature.

15. The device according to claim 11, wherein the voltage control oscillating circuit, the second amplification circuit, the mixer, and the PLL circuit are arranged such that a distance between the voltage control oscillating circuit and both the second amplification circuit and the mixer is longer than a distance between the voltage control oscillating circuit and the PLL circuit.

16. The device according to claim 15, wherein when the second amplification circuit has a higher power consumption than the mixer, the distance between the voltage control oscillating circuit and the second amplification circuit is longer than the distance between the voltage control oscillating circuit and the mixer.

* * * * *